US010704332B2

(12) United States Patent
Hird et al.

(10) Patent No.: US 10,704,332 B2
(45) Date of Patent: Jul. 7, 2020

(54) DOWNHOLE ROTARY CUTTING TOOL

(71) Applicant: SCHLUMBERGER TECHNOLOGY CORPORATION, Sugar Land, TX (US)

(72) Inventors: Jonathan Robert Hird, Cambridge (GB); Ashley Bernard Johnson, Cambridge (GB); Göktürk Tunç, Cambridge (GB)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 110 days.

(21) Appl. No.: 15/328,059

(22) PCT Filed: Jul. 21, 2015

(86) PCT No.: PCT/US2015/041280
§ 371 (c)(1),
(2) Date: Jan. 23, 2017

(87) PCT Pub. No.: WO2016/014490
PCT Pub. Date: Jan. 28, 2016

(65) Prior Publication Data

US 2017/0211333 A1 Jul. 27, 2017

(30) Foreign Application Priority Data

Jul. 21, 2014 (GB) ..... 1412929.0
Jun. 1, 2015 (GB) ..... 1509434.5

(51) Int. Cl.
*E21B 10/32* (2006.01)
*E21B 7/28* (2006.01)
*E21B 10/567* (2006.01)

(52) U.S. Cl.
CPC ..... *E21B 10/32* (2013.01); *E21B 7/28* (2013.01); *E21B 10/322* (2013.01); *E21B 10/567* (2013.01)

(58) Field of Classification Search
CPC ..... E21B 10/46; E21B 10/26; E21B 10/325; E21B 10/43; E21B 10/32; E21B 10/322
See application file for complete search history.

(56) References Cited

U.S. PATENT DOCUMENTS 4,431,065 A * 2/1984 Andrews ..... E21B 10/567 175/269
4,440,247 A 4/1984 Sartor
(Continued)

FOREIGN PATENT DOCUMENTS

CA 2397110 A1 * 2/2003 ..... E21B 10/32
CA 2821495 A1 * 6/2012 ..... E21B 10/43
(Continued)

OTHER PUBLICATIONS

International Search Report and Written Opinion for related Application Serial No. PCT/US2014/068991, dated Mar. 25, 2015, 14 pages.
(Continued)

*Primary Examiner* — Jennifer H Gay

(57) ABSTRACT

A rotary cutting tool, which may be a reamer for enlarging an underground borehole or a mill to remove tubing by cutting into the inside wall of the tubing, has a plurality of cutter assemblies distributed azimuthally around a longitudinal axis of the tool, wherein each cutter assembly includes a supporting structure bearing a sequence of cutters which extends axially along the tool with leading surfaces facing in a direction of rotation of the tool. The cutters of each sequence are positioned at a plurality of circumferential positions such that no more than three cutters of the sequence are aligned on any line parallel to the longitudinal
(Continued)

axis of the tool. In an overlapping arrangement, a plurality of cutters in the sequence may have a leading face circumferentially behind the leading face but ahead of the trailing end of at least one other cutter.

15 Claims, 14 Drawing Sheets

(56) References Cited

U.S. PATENT DOCUMENTS 4,499,959 A * 2/1985 Grappendorf ..... E21B 47/18 175/405.1
4,515,227 A 5/1985 Cerkovnik
4,593,777 A 6/1986 Barr
4,710,074 A 12/1987 Springer
4,887,668 A 12/1989 Lynde et al.
5,070,952 A * 12/1991 Neff ..... E21B 10/322 166/55.7
5,238,075 A * 8/1993 Keith ..... E21B 10/55 175/431
5,341,888 A 8/1994 Deschutter
5,495,899 A * 3/1996 Pastusek ..... E21B 10/26 175/385
5,531,281 A * 7/1996 Murdock ..... E21B 10/43 175/431
5,967,247 A 10/1999 Pessier
6,397,958 B1 * 6/2002 Charles ..... E21B 10/16 175/391
6,732,817 B2 * 5/2004 Dewey ..... E21B 7/067
6,880,650 B2 4/2005 Hoffmaster et al.
6,920,923 B1 7/2005 Pietrobelli et al.
7,467,671 B2 12/2008 Savignat et al.
7,506,703 B2 * 3/2009 Campbell ..... E21B 10/322 175/263
7,571,782 B2 * 8/2009 Hall ..... E21B 10/43 175/425
7,726,415 B1 * 6/2010 Tipton ..... E21B 10/26 175/385
7,954,564 B2 * 6/2011 Makkar ..... E21B 10/322 175/263
7,963,348 B2 6/2011 Laird et al.
7,975,783 B2 7/2011 Fanuel et al.
8,162,081 B2 * 4/2012 Ballard ..... E21B 10/26 175/325.2
8,205,689 B2 6/2012 Radford
8,297,381 B2 10/2012 Radford et al.
8,517,124 B2 * 8/2013 Hareland ..... E21B 10/62 175/393
8,550,188 B2 10/2013 Makkar et al.
8,607,900 B1 * 12/2013 Smith ..... E21B 10/26 175/323
8,720,611 B2 * 5/2014 Chen ..... E21B 10/43 175/398
8,752,649 B2 * 6/2014 Isenhour ..... E21B 10/26 175/57
8,776,912 B2 * 7/2014 Makkar ..... E21B 7/28 175/263
8,905,126 B2 12/2014 Krieg et al.
9,051,793 B2 * 6/2015 Makkar ..... E21B 10/322
9,068,407 B2 6/2015 Radford et al.
9,074,434 B2 * 7/2015 Mensa-Wilmot ..... E21B 10/43
9,187,958 B2 * 11/2015 Mensa-Wilmot ..... E21B 7/28
9,273,519 B2 * 3/2016 Smith ..... E21B 10/26
9,359,825 B2 * 6/2016 Gavia ..... E21B 10/43
9,593,538 B2 3/2017 Rasheed
9,739,094 B2 * 8/2017 Moreno, II ..... E21B 10/26
9,864,821 B2 * 1/2018 Chen ..... E21B 10/43
2001/0020552 A1 9/2001 Beaton et al.
2002/0166703 A1 * 11/2002 Presley ..... E21B 10/16 175/391
2003/0029644 A1 2/2003 Hoffmaster et al.
2003/0155155 A1 * 8/2003 Dewey ..... E21B 7/067 175/57
2004/0188149 A1 9/2004 Thigpen et al.
2004/0222022 A1 11/2004 Nevlud et al.
2005/0034897 A1 2/2005 Youan
2007/0089912 A1 4/2007 Eddison et al.
2007/0163808 A1 * 7/2007 Campbell ..... E21B 10/322 175/57
2007/0205024 A1 * 9/2007 Mensa-Wilmot ..... E21B 10/43 175/408
2007/0272446 A1 11/2007 Mensa-Wilmot
2008/0128174 A1 * 6/2008 Radford ..... E21B 10/322 175/267
2008/0128175 A1 * 6/2008 Radford ..... E21B 10/322 175/269
2008/0149396 A1 6/2008 Fyfe
2008/0190670 A1 * 8/2008 Welch ..... E21B 10/43 175/430
2008/0314645 A1 * 12/2008 Hall ..... E21B 10/43 175/374
2009/0145666 A1 * 6/2009 Radford ..... E21B 10/30 175/269
2009/0294173 A1 * 12/2009 Laird ..... E21B 12/02 175/39
2009/0294178 A1 12/2009 Radford
2009/0321138 A1 * 12/2009 Shamburger ..... E21B 10/43 175/61
2010/0012387 A1 * 1/2010 Huynh ..... E21B 10/43 175/428
2010/0018779 A1 * 1/2010 Makkar ..... E21B 10/322 175/382
2010/0051349 A1 * 3/2010 Ballard ..... E21B 10/26 175/57
2010/0089649 A1 * 4/2010 Welch ..... E21B 10/43 175/61
2010/0263875 A1 10/2010 Williams et al.
2010/0276201 A1 * 11/2010 Makkar ..... E21B 7/28 175/57
2011/0005836 A1 1/2011 Radfprd et al.
2011/0005841 A1 1/2011 Wood et al.
2011/0031029 A1 * 2/2011 Gavia ..... E21B 10/43 175/428
2011/0120777 A1 5/2011 Lee
2011/0127087 A1 * 6/2011 Hareland ..... E21B 10/602 175/393
2011/0259650 A1 * 10/2011 Hall ..... E21B 10/43 175/430
2012/0012398 A1 1/2012 Hall et al.
2012/0073879 A1 * 3/2012 Makkar ..... E21B 10/322 175/406
2012/0138365 A1 * 6/2012 Maurstad ..... E21B 10/43 175/57
2012/0152543 A1 6/2012 Davis
2012/0152623 A1 * 6/2012 Chen ..... E21B 10/43 175/428
2012/0205151 A1 8/2012 Inoue et al.
2012/0205157 A1 8/2012 Radford et al.
2012/0255786 A1 * 10/2012 Isenhour ..... E21B 10/26 175/57
2013/0075167 A1 * 3/2013 Knull ..... E21B 10/43 175/428
2013/0087386 A1 4/2013 Radford et al.
2013/0146361 A1 * 6/2013 Makkar ..... E21B 10/322 175/57
2013/0199855 A1 8/2013 Shears
2013/0256036 A1 10/2013 Lyons
2013/0306380 A1 * 11/2013 Oesterberg ..... E21B 10/32 175/263
2013/0341100 A1 * 12/2013 Zhang ..... E21B 10/46 175/375
2014/0008128 A1 * 1/2014 Adam ..... E21B 10/32 175/57
2014/0048335 A1 * 2/2014 Mensa-Wilmot ..... E21B 7/28 175/263
2014/0048336 A1 * 2/2014 Mensa-Wilmot ..... E21B 10/32 175/266
2014/0097024 A1 4/2014 Haugvaldstad
2014/0246247 A1 * 9/2014 Smith ..... E21B 10/26 175/394

(56) References Cited

U.S. PATENT DOCUMENTS

| | | | | |
|---|---|---|---|---|
| 2014/0262523 | A1 | 9/2014 | Davis | |
| 2014/0278282 | A1* | 9/2014 | Chen | E21B 10/43 703/1 |
| 2015/0068813 | A1* | 3/2015 | Moreno, II | E21B 10/26 175/263 |
| 2015/0144405 | A1* | 5/2015 | Salvo | E21B 10/322 175/263 |
| 2016/0290067 | A1* | 10/2016 | Tipples | E21B 17/1078 |
| 2016/0305190 | A1 | 10/2016 | Johnson et al. | |
| 2017/0058611 | A1* | 3/2017 | Lin, Jr. | E21B 10/43 |
| 2017/0204670 | A1* | 7/2017 | Hird | E21B 10/322 |
| 2017/0211332 | A1* | 7/2017 | Hird | E21B 10/322 |
| 2017/0211333 | A1* | 7/2017 | Hird | E21B 10/322 |
| 2017/0211334 | A1* | 7/2017 | Hird | E21B 10/322 |
| 2017/0211335 | A1* | 7/2017 | Hird | E21B 10/43 |
| 2017/0218707 | A1* | 8/2017 | Hird | E21B 10/567 |
| 2018/0094496 | A1* | 4/2018 | Su | E21B 29/002 |
| 2018/0179825 | A1* | 6/2018 | Johnson | E21B 10/322 |

FOREIGN PATENT DOCUMENTS

| | | | | |
|---|---|---|---|---|
| CN | 102086756 | A | 6/2011 | |
| EP | 0385673 | A1 | 9/1990 | |
| EP | 0397417 | A1 | 11/1990 | |
| EP | 0869256 | A2 | 10/1998 | |
| EP | 1811124 | A1 | 7/2007 | |
| EP | 2097610 | A1 | 9/2009 | |
| GB | 2339227 | B | 11/2002 | |
| GB | 2417267 | A | 2/2006 | |
| GB | 2520998 | A | 6/2015 | |
| WO | 03102354 | A1 | 12/2003 | |
| WO | 2004101943 | A2 | 11/2004 | |
| WO | 2005047644 | A1 | 5/2005 | |
| WO | 2005/052301 | A2 | 6/2005 | |
| WO | 2007041811 | A1 | 4/2007 | |
| WO | 2008100194 | A2 | 8/2008 | |
| WO | 2010126938 | A2 | 11/2010 | |
| WO | WO-2011017394 | A2 * | 2/2011 | E21B 10/43 |
| WO | 2013134629 | A1 | 9/2013 | |
| WO | 2013167954 | A2 | 11/2013 | |
| WO | WO-2013173607 | A1 * | 11/2013 | E21B 10/32 |
| WO | 2014028457 | A1 | 2/2014 | |
| WO | 2014150524 | A2 | 9/2014 | |
| WO | 2014159079 | A1 | 10/2014 | |
| WO | 2015054227 | A2 | 4/2015 | |
| WO | WO-2015167786 | A1 * | 11/2015 | E21B 10/322 |
| WO | WO-2015167788 | A1 * | 11/2015 | E21B 10/43 |

OTHER PUBLICATIONS

Search Report under Section 17 of UK Patent Application No. 1412934.0, dated Jan. 16, 2015, 4 pages.
Exam Report under Section 18(3) of UK Patent Application No. 1412934.0, dated Sep. 2, 2016, 2 pages.
Search Report and Written Opinion of International Patent Application No. PCT/US2015/041224, dated Oct. 8, 2015, 11 pages.
Office Action issued in U.S. Appl. No. 15/328,051, dated Aug. 24, 2018, 22 pages.
Search Report and Written Opinion of International Patent Application No. PCT/US2015/041260, dated Oct. 19, 2015, 11 pages.
Search Report under Section 17(5) of UK Patent Application No. 1412933.2, dated Dec. 22, 2015, 4 pages.
Search Report under Section 17(5) of UK Patent Application No. 1412932.4, dated Jan. 16, 2015, 3 pages.
Exam Report under Section 18(3) of UK Patent Application No. 1412932.4, dated Jan. 23, 2018, 4 pages.
Exam Report under Section 18(3) of UK Patent Application No. 1412932.4, dated Nov. 18, 2016, 5 pages.
Search Report and Written Opinion of International Patent Application No. PCT/US2015/041265, dated Oct. 8, 2015, 12 pages.
Search Report under Section 17(5) of UK Patent Application No. 1412932.4, dated Jan. 12, 2015, 3 pages.
Search Report and Written Opinion of International Patent Application No. PCT/US20151041223, dated Oct. 19, 2015, 11 pages.
Search Report under Section 17(5) of UK Patent Application No. 1412929.0, dated Jan. 12, 2015, 3 pages.
Combined Search and Exam Report under Sections 17 and 18(3) of UK Patent Application No. 1321625.4, dated Nov. 25, 2015, 8 pages.
Combined Search and Exam Report under Sections 17 and 18(3) of UK Patent Application No. 1412930.8, dated Jan. 12, 2015, 5 pages.
Search Report and Written Opinion of International Patent Application No. PCT/US20151040295, dated Oct. 12, 2015, 12 pages.
Combined Search and Exam Report under Sections 17 and 18(3) of UK Patent Application No. 1321625.4, dated May 1, 2014, 5 pages.
European Search Report of EP Patent Application No. 14868423.6, dated Nov. 23, 2016, 3 pages.
European Exam Report of EP Patent Application No. 14868423.6, dated Jan. 3, 2017, 5 pages.
Office Action issued in US Appl. No. 15/102,039, dated Jun. 1, 2018, 15 pages.

* cited by examiner

DOWNHOLE ROTARY CUTTING TOOL

CROSS-REFERENCE TO RELATED APPLICATION

This application claims priority to UK Patent Application No. GB 1412929.0, which is incorporated herein in its entirety by reference.

BACKGROUND

There are a number of wellbore tools which can be operated to enlarge an existing hole as the tool is rotated and advanced axially along the existing hole. Some tools with this function have a plurality of cutter assemblies distributed axially around a longitudinal axis of the tool and each cutter assembly includes a sequence of cutters which extends axially along the tool with each cutter having a leading surface facing in a direction of rotation of the tool.

One wellbore tool which may be constructed to come within this category is a reamer. A reamer may be constructed to have a fixed diameter, in which case the reamer must start cutting at the surface or at the end of an existing hole of equal or greater size. Alternatively a reamer can be constructed so as to be expandable so that it can enlarge a borehole to a greater diameter than that of the hole through which the (unexpanded) reamer was inserted.

Enlarging a borehole with a reamer may be done as a separate operation to enlarge an existing borehole drilled at an earlier time. Enlarging with a reamer may also be done at the same time as using a bottom hole assembly which has a drill bit at its bottom end. The drill bit makes an initial hole, sometimes referred to as pilot hole, and a reamer positioned at some distance above the drill bit increases the hole diameter.

There is more than one type of reaming tool. Some reamers are constructed to be eccentric, relative to the drill string to which they are attached and the borehole which they are enlarging. Other reamers are constructed to remain concentric with the drill string and the borehole. These different types of reamers tend to be used in different circumstances. There are many instances where concentric reamers are the appropriate choice.

A reamer may have a plurality of cutter assemblies, each comprising a support structure with attached cutters, arranged azimuthally around the axis of the tool. In the case of an expandable reaming tool it is common to have a plurality of radially expandable support elements bearing cutters positioned around the axis of the tool. Often the tool has three such cutter assemblies which extend axially and are arranged at 120° intervals azimuthally around the tool axis. A mechanism is provided for expanding these cutter assemblies radially outwardly from the axis and this mechanism typically uses hydraulic pressure to force the support structures of the cutter assemblies outwardly. Some reamer designs position at least some cutters with their cutting faces at the leading face of a support structure. These cutters may be aligned along a line which is parallel to, but radially outward from, the tool axis.

This tool construction has commonly been used for concentric reamers. In some constructions, each of the individual cutter assemblies arranged around the tool axis is an assembly of parts attached together so as to move bodily as one piece, in which case the assembly is often referred to as a "block" (one part of this assembly may be a shaped monolithic block) although the term "arm" has also been used for such an assembly. The individual cutter assemblies (i.e. individual blocks) may be moved outwards in unison by one drive mechanism acting on them all, or may be moved outwards by drive mechanism(s) which does not constrain them to move in unison.

Cutters attached to the supporting structure may be so-called PDC cutters having a body of hard material with an even harder polycrystalline diamond section at one end. In many instances, the polycrystalline diamond section is a disc so that the hardest end of a cutter is a flat surface but other shapes can also be used.

Reamer designs customarily position at least some cutters with their cutting faces at the leading face of a support structure and with the cutters projecting radially outwardly from the support structure. The parts of the cutter which project outwardly beyond the support structure may be the parts of the cutter principally involved in cutting as the rotating reamer is advanced and/or cutting radially outwards as an expandable reamer is expanded.

A desirable characteristic for a rotary cutting tool working in a borehole, is that the tool maintains stable cutting behaviour, centred on the axis of the existing bore, even though it may have significant mass of collars and other drill string components placed above and/or below it. Yet frontal area in frictional contact with the formation, which helps to dampen oscillations, is smaller than with a drill bit of the same diameter. It has been observed that reamers tend to be more prone to the phenomenon of whirling than are drill bits. In this context, whirling refers to a motion in which the tool axis moves around a centre line of the hole rather than staying on it. The consequence can be that the enlarged hole produced by the tool is mis-shaped or oversized.

SUMMARY

This summary is provided to introduce a selection of concepts that are further described below. This summary is not intended to be used as an aid in limiting the scope of the subject matter claimed.

In one aspect, the subject matter disclosed here provides a rotary cutting tool for enlarging an underground hole, comprising a plurality of cutter assemblies distributed azimuthally around a longitudinal axis of the tool, wherein each cutter assembly includes a supporting structure bearing a sequence of cutters which extends axially along the tool with each cutter having a leading surface facing in a direction of rotation of the tool, and wherein the cutters are positioned at a plurality of circumferential positions such that the leading faces of no more than three, preferably no more than two, cutters of the sequence are aligned on any line parallel to the longitudinal axis of the tool.

A said sequence of cutters may have each cutter at a different radial distance from the longitudinal axis of the tool. However, some embodiments have a sequence of cutters comprising a plurality at the maximum radial distance from the longitudinal tool axis and a smaller sequence in which each is at a different radial distance from the longitudinal axis of the tool.

Limiting the number of cutters aligned on any line parallel to the tool axis may enhance stability during cutting by reducing opportunity for the tool to twist around the radial extremity of a cutter or around the radial extremities of a number of cutters aligned on a line parallel to the tool axis, which may for instance attempt to happen if a cutter snags on the formation which is being cut instead of cutting steadily through it.

In some embodiments the circumferential positioning of the cutters may be such that the circumferential spacing between the leading faces of the cutters at the circumferentially leading and trailing positions is not more than three times, possibly not more than twice, the radial extent (relative to the tool axis) of the leading faces of the cutters. Having such a constraint on the circumferential positioning is a space-saving arrangement. In some embodiments a plurality of cutters behind the leading cutter in the sequence each has its leading face circumferentially behind the leading face but ahead of the trailing end of at least one other cutter.

In a second aspect the subject matter disclosed here provides a rotary cutting tool for enlarging an underground hole, comprising a plurality of cutter assemblies distributed azimuthally around a longitudinal axis of the tool, wherein each cutter assembly includes a supporting structure bearing a sequence of cutters which extends axially along the tool with each cutter comprising a body having a leading surface facing in a direction of rotation of the tool and with each cutter at a different radial distance from the longitudinal axis of the tool, and wherein the cutters are positioned at a plurality of circumferential positions which run from a cutter at a circumferentially leading position to a cutter at a circumferentially trailing position and are such that the circumferential spacing between the leading faces of the cutters at the circumferentially leading and trailing positions is not more than three times, preferably not more than twice, the radial extent of the leading faces of the cutters.

In a third aspect the subject matter disclosed here provides a rotary cutting tool for enlarging an underground hole, comprising a plurality of cutter assemblies distributed azimuthally around a longitudinal axis of the tool, wherein each cutter assembly comprises support structure bearing a sequence of cutters which extends axially along the tool with leading surfaces facing in a direction of rotation of the tool, wherein the cutters are positioned at a plurality of circumferential positions such that a plurality of cutters in the sequence each has its leading face circumferentially behind the leading face but ahead of the trailing end of at least one other cutter.

In any of the above aspects of the subject matter disclosed here, the sequence of cutters could, as a minimum, be a sequence of three cutters. If so, two of these cutters may be positioned with their leading faces circumferentially between the leading face and trailing end of at least one other cutter. In a number of embodiments the sequence contains more than this minimum number of cutters. The sequence may have at least four cutters and if so, at least three may be positioned such that each of these three has its leading face circumferentially between the leading face and trailing end of at least one other cutter.

One possibility is that the sequence of cutters comprises one or more cutters at a leading edge of the cutter assembly and a plurality of cutters behind the leading edge. In some embodiments, some or all cutters in the sequence may be at full gauge, i.e. positioned at maximum radial distance from the tool axis. In some embodiments, at least some of the cutters may be at varying radial distances from the tool axis, as is normal in an end portion of a cutter assembly, used to progressively enlarge a hole as the rotating cutting tool advances axially. One possibility is that a cutter assembly comprises one or more cutters which are at full gauge and are aligned at the leading edge of the cutter assembly and also comprises a plurality of cutters which are radially inwardly from full gauge and at differing distances from the tool axis. The cutters in the latter plurality may be positioned so as to have leading face circumferentially between the leading face and trailing end of at least one other cutter.

In some embodiments, a plurality of cutters which are positioned so as to have leading face circumferentially behind the leading face of at least one cutter or cutters are arranged so that their circumferential distance behind the leading cutter or leading cutters increase progressively along the sequence. However, other possible arrangements do not have this progressive layout. The circumferential distances may be mixed so that from one cutter to the next along the sequence there are both increases and decreases in the circumferential distance behind the leading cutter(s) of the sequence.

In order to allow insertion of cutters into their positions in the support structure, there may be recesses in the support structure extending circumferentially ahead of at least some cutters.

Cutters used in accordance with the concepts disclosed above may comprise bodies with hard surfaces exposed as the leading faces of the cutters. These hard surfaces may be planar but other shapes, such as a domed or conical shape, are possible. A hard material may have a hardness of 1800 or more on the Knoop scale or a hardness of 9 or more on the original Mohs scale (where diamond has a Mohs hardness of 10). Hard surfaced cutters may be polycrystalline diamond (PDC) cutters which have diamond crystals embedded in a binder material providing a hard face at one end of a cutter body. The radially outer extremity of a cutter may be located at a point at which the circular or other shape of the exposed leading face reaches its maximum distance from the tool axis. However, another possibility is that the cutter is shaped and positioned so that its outer extremity is not a point but is a linear edge parallel to the tool axis or an approximately planar face extending back from such an edge.

In some embodiments the rotary tool is a reamer which can be used to enlarge a borehole by cutting formation rock from the borehole wall. Such a tool may have cutters with polycrystalline diamond at the hard cutting surface. In other embodiments the rotary tool is a mill to remove metal from the interior wall of tubing secured in a borehole, possibly removing the entire thickness of the tubing wall from the interior so as to destroy the tubing by comminuting it to swarf. A mill to remove metal may have cutters of tungsten carbide or other hard material which is not diamond.

In further aspects, this disclosure includes methods of enlarging a borehole or removing tubing by rotating any tool as defined above in the borehole or tubing and advancing the tool axially. Such methods may include expanding a tool which has expandable cutter assemblies and then rotating the tool while also advancing the expanded tool axially. Such methods may include flowing fluid from the surface to the tool and returning fluid from the tool to the surface while rotating and advancing the tool.

DETAILED DESCRIPTION

Figure 1:
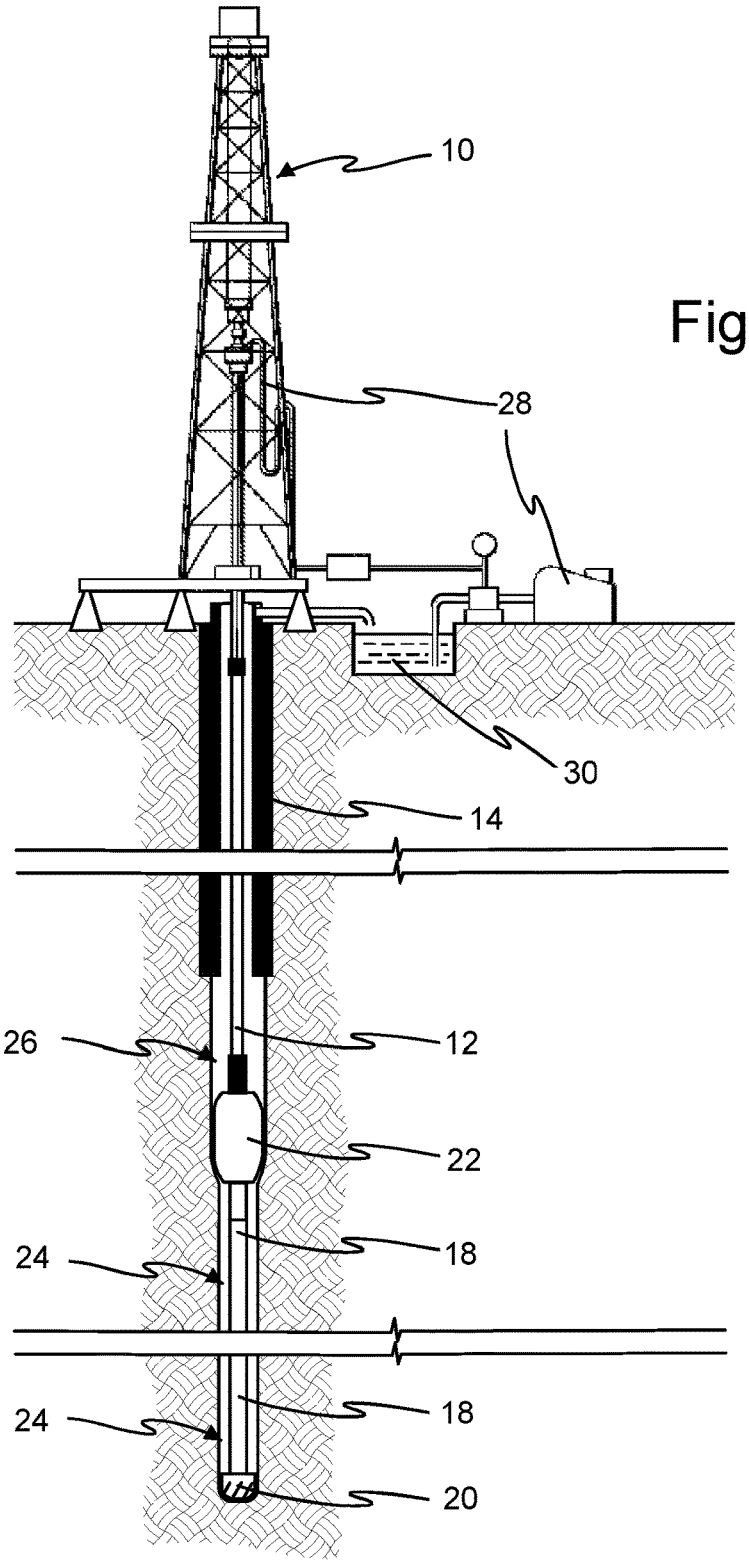
FIG. 1 is a schematic, cross-sectional view of a drilling assembly in a borehole.

FIG. 1 shows an exemplary drilling assembly which includes an expandable under-reamer 22. A drill string 12 extends from a drilling rig 10 into a borehole. An upper part of the borehole has already been lined with casing and cemented as indicated at 14. The drill string 12 is connected to a bottomhole assembly 18 which includes a drill bit 20 and an under-reamer 22 which has been expanded beneath the cased section 14. As the drill string 12 and bottomhole assembly 18 are rotated, the drill bit 20 extends a pilot hole 24 downwards while the reamer 22 simultaneously opens the pilot hole 24 to a larger diameter borehole 26.

The drilling rig is provided with a system 28 for pumping drilling fluid from a supply 30 down the drill string 12 to the reamer 22 and the drill bit 20. Some of this drilling fluid flows through passages in the reamer 22 and flows back up the annulus around the drill string 12 to the surface. The rest of the drilling fluid flows out through passages in the drill bit 20 and also flows back up the annulus around the drill string 12 to the surface. The distance between the reamer 22 and the drill bit 20 at the foot of the bottom hole assembly is fixed so that the pilot hole 24 and the enlarged borehole 26 are extended downwardly simultaneously.

Figure 5:
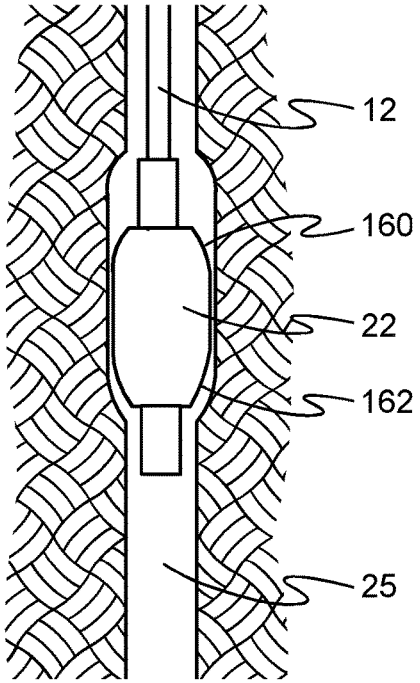
FIG. 5 is a schematic, cross-sectional view of the reamer expanded in a pre-existing borehole.

As shown in FIG. 5, it would similarly be possible to use the same reamer 22 attached to drill string 12, although without the drill bit 20 and the part of the bottom hole assembly 18 shown below the reamer 22 in FIG. 1, to enlarge a borehole 25 which had been drilled previously. In FIG. 5, the initial expansion of the reamer has created a fairly short section where the borehole has enlarged diameter. This enlarged portion of the borehole can then be elongated downwardly by advancing the drill string 12 and reamer 22 downwardly.

Figure 2:
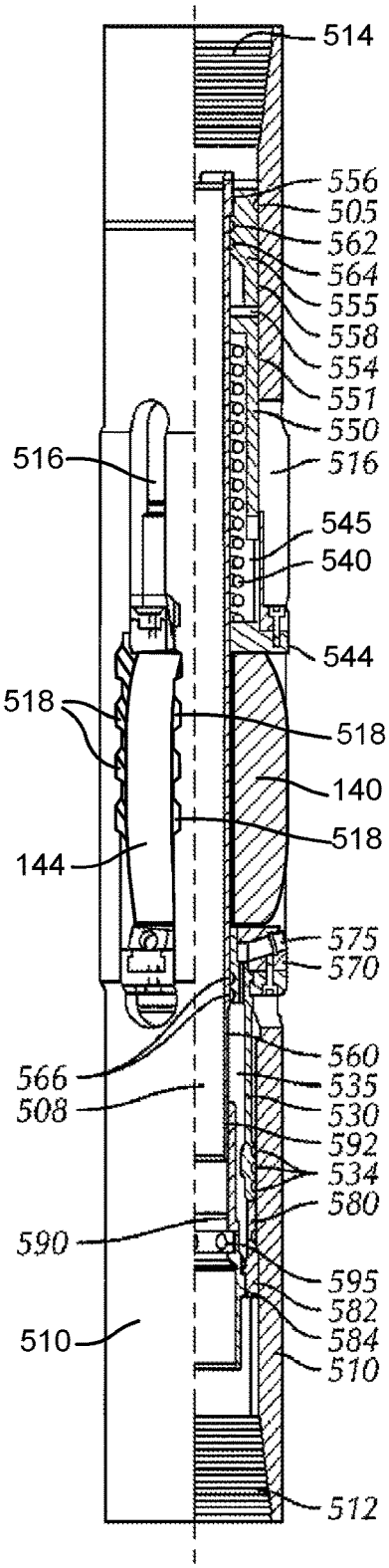
FIG. 2 is a cross-sectional elevation view of one embodiment of expandable reamer, showing its expandable cutter blocks in collapsed position.
Figure 3:
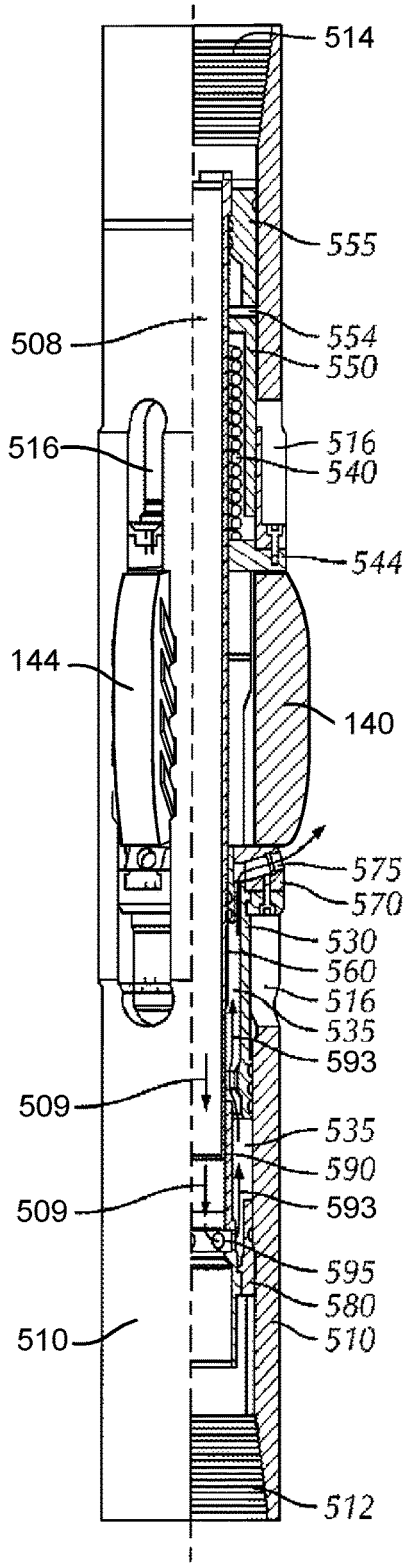
FIG. 3 is a cross-sectional elevation view of the expandable reamer of FIG. 2, showing the blocks in expanded position.

Referring now to FIGS. 2 and 3, one embodiment of expandable reaming tool is shown in a collapsed position in FIG. 2 and in an expanded position in FIG. 3. The expandable tool comprises a generally cylindrical tool body 510 with a central flowbore 508 for drilling fluid. The tool body 510 includes upper 514 and lower 512 connection portions for connecting the tool into a drilling assembly. Intermediately between these connection portions 512, 514 there are three recesses 516 formed in the body 510 and spaced apart at 120° intervals azimuthally around the axis of the tool.

Each recess 516 accommodates a cutter assembly 140 in its collapsed position. This cutter assembly has the general form of a block, and comprises support structure to which cutters are attached. One such cutting block 140 is shown in perspective in FIG. 4. The block 140 has an outer face 144 which confronts the wall of the borehole and side faces with protruding ribs 142 which extend at an angle to the tool axis. These ribs 142 engage in channels 518 at the sides of a recess 516 and thus provide a guide mechanism such that when the block 140 is pushed upwardly relative to the tool body 510, it also moves radially outwardly to the position shown in FIG. 3 in which the blocks 140 extend radially outwardly from the tool body 510. The blocks move in unison and so are all at the same axial positions relative to the tool body. Details of the outer face 144 of a block 140 have been omitted from FIGS. 2 and 3.

A spring 540 biases the block 140 downwards to the collapsed position of FIG. 2. The biasing spring 540 is disposed within a spring cavity 545 and covered by a spring retainer 550 which is locked in position by an upper cap 555. A stop ring 544 is provided at the lower end of spring 540 to keep the spring in position.

Below the moveable blocks 140, a drive ring 570 is provided that includes one or more nozzles 575. An actuating piston 530 that forms a piston cavity 535 is attached to the drive ring 570. The piston 530 is able to move axially within the tool. An inner mandrel 560 is the innermost component within the tool 500, and it slidingly engages a lower retainer 590 at 592. The lower retainer 590 includes ports 595 that allow drilling fluid to flow from the flowbore 508 into the piston chamber 535 to actuate the piston 530.

The piston 530 sealingly engages the inner mandrel 560 at 566, and sealingly engages the body 510 at 534. A lower cap 580 provides a stop for the downward axial movement of piston 530. This cap 580 is threadedly connected to the body 510 and to the lower retainer 590 at 582, 584, respectively. Sealing engagement is provided at 586 between the lower cap 580 and the body 510.

A threaded connection is provided at 556 between the upper cap 555 and the inner mandrel 560 and at 558 between the upper cap 555 and body 510. The upper cap 555 sealingly engages the body 510 at 505, and sealingly engages the inner mandrel 560 at 562 and 564.

In operation, drilling fluid flows down flowbore 508 as indicated by arrow 509, through ports 595 in the lower retainer 590 and along path 593 into the piston chamber 535. The differential pressure between the fluid in the flowbore 508 and the fluid in the borehole annulus surrounding tool 500 causes the piston 530 to move axially upwardly from the position shown in FIG. 2 to the position shown in FIG. 3. A small amount of flow can pass through the piston chamber 535 and through nozzles 575 to the annulus as the tool 500 starts to expand. As the piston 530 moves axially upwardly, it urges the drive ring 570 axially upwardly against the blocks 140. The drive ring pushes on all the blocks 140 simultaneously and moves them all axially upwardly in recesses 516 and also radially outwardly as the ribs 142 slide in the channels 518. The blocks 140 are thus driven upwardly and outwardly in unison towards the expanded position shown in FIG. 3.

The movement of the blocks 140 is eventually limited by contact with the spring retainer 550. When the spring 540 is fully compressed against the retainer 550, it acts as a stop and the blocks can travel no further. There is provision for adjustment of the maximum travel of the blocks 140. The spring retainer 550 connects to the body 510 via a screwthread at 551. A wrench slot 554 is provided between the upper cap 555 and the spring retainer 550, which provides room for a wrench to be inserted to adjust the position of the screwthreaded spring retainer 550 in the body 510. This allows the maximum expanded diameter of the reamer to be set at the surface. The upper cap 555 is also a screwthreaded component and it is used to lock the spring retainer 550 once it has been positioned.

Figure 4:
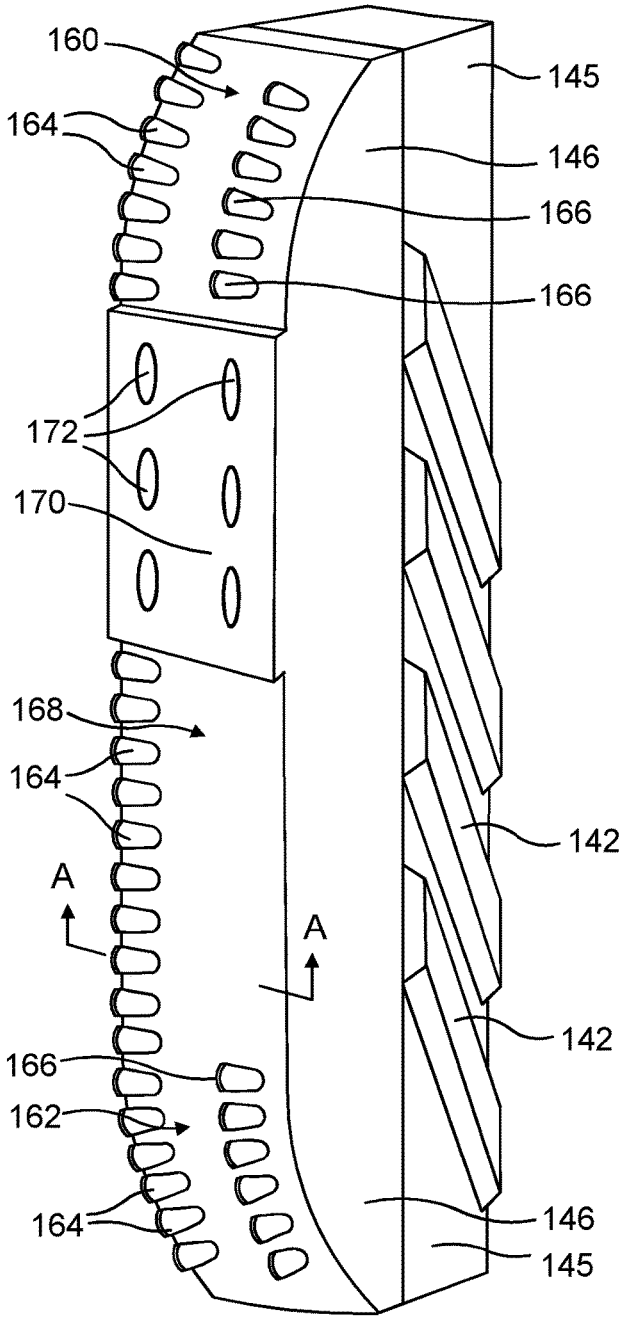
FIG. 4 is a perspective view of a cutter block for the expandable reamer of FIGS. 2 and 3.

FIG. 4 is a perspective view of a cutter block 140 showing the outer face of the block and the side face which is the trailing face in the direction of rotation. There is a conventional arrangement of cutters on the outer face. The block is formed of an inner part 145 and an outer part 146 bolted to the part 145 by bolts (not shown). The inner part 145 is steel and incorporates the protruding ribs 142. The outer part 146 of the block 140 is also steel and has polycrystalline diamond (PDC) cutters secured to it.

Figure 6:
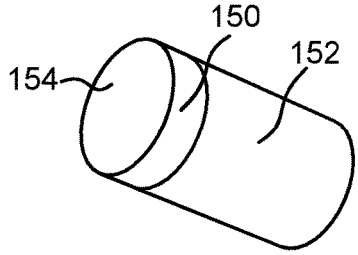
FIG. 6 is a detail view of a PDC cutter.

As shown in FIG. 6 such cutters have a sintered disc 150 of diamond crystals sintered together with a binder material and also attached by the sintering process to one end of a cylindrical body 152 which may be a sintered mass of tungsten carbide particles and a binder material. Manufacture of such cutters is well known. Suppliers include the Element 6 group of companies at Spring, Tex. and US Synthetics Corporation of Orem, Utah. The bodies 152 of cutters are secured, for example by brazing, to the outer part 146 of the block 140 so that the hard faces 154 of the cutters (printed by the sintered diamond crystals) are exposed. Although the cutter shown in FIG. 6 has a hard face 154 which is flat, other shapes including cones can be used for the hard face.

The outer part 146 of the block 140 has upper and lower cutting portions 160, 162 on which PDC cutters are arranged in a leading row of cutters 164 and a following row of cutters 166. It will be appreciated that the upper and lower cutting portions 160, 162 are inclined (they are curved as shown) so that the cutters in these regions extend outwards from the tool axis by amounts which are least at the top and bottom ends of the block 140 and greatest adjacent the middle section 168 which includes stabilising pad 170.

When a reamer is advanced downwardly within a hole to enlarge the hole, it is the curved lower cutting portions 162 which do the work of cutting through formation rock. This takes place in FIGS. 1 and 5 as the drill string is advanced. The enlarged portion of the borehole can also be extended upwardly using the cutting portions 160 on the blocks 140 to remove formation rock while pulling upwardly on the drill string 12. The leading row of cutters 164 has the cutters positioned side by side and spaced axially apart. The following row of cutters 166 also has the cutters spaced apart but the cutters in this following row are positioned circumferentially behind the spaces between adjacent cutters in the front row. If a portion of the rock to be cut passes between cutters of the leading row, it is cut by a cutter of the trailing row.

The stabilising pad 170 does not include cutters but has a generally smooth, part-cylindrical outward surface positioned to face and slide over the borehole wall. To increase resistance to wear, the stabilising pad 170 may have pieces 172 of harder material embedded in it and lying flush with the outward facing surface.

Figure 7:
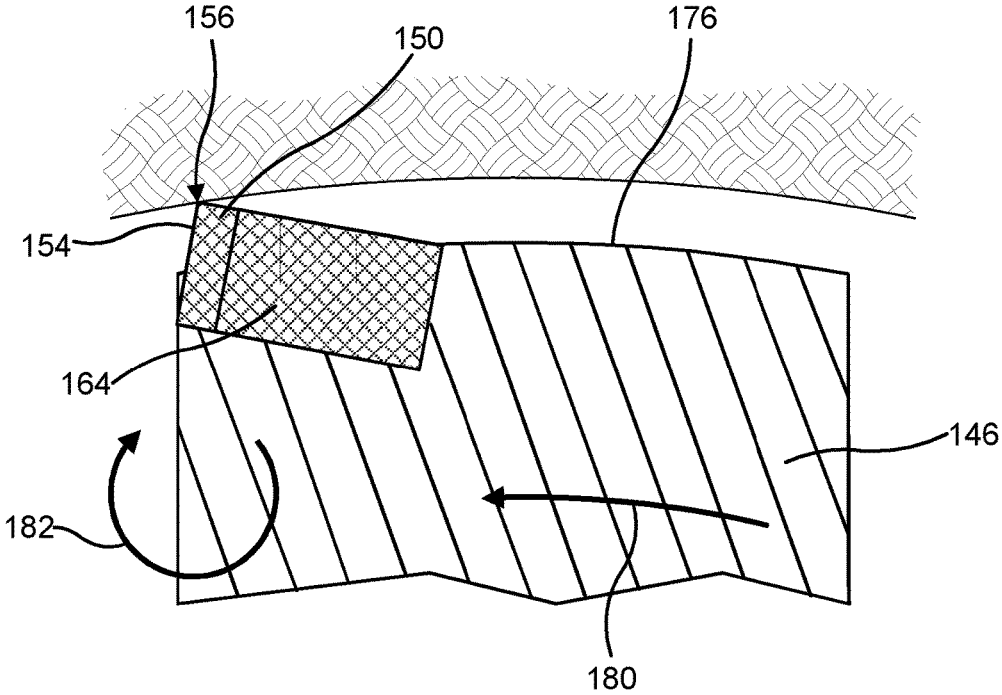
FIG. 7 is a cross section on line A-A of FIG. 4.

FIG. 7 is a section on line A-A of FIG. 4 showing one front row PDC cutter 164 mounted to the outer part 146 of the block 142. The cutter 164 is partially embedded in the outer part 146 and is oriented so that the hard face 154 will be facing forwards when the reamer is rotated. The direction of rotation is indicated by arrow 180. This hard face extends outwards to an extremity 156 which is at the maximum radius swept by the rotating reamer (i.e. its full gauge). The extremities of the other PDC cutters secured to the middle region 168 are also at the maximum radius swept by the rotating reamer. The outer surface of the support structure is indicated at 176.

Without limitation as to theory, the inventors believe that the extremity 156 of a cutter can become a pivot point, for instance if the extremity 156 snags briefly on the rock wall of the borehole as the reamer is rotated, rather than cutting steadily through the rock. The reamer may attempt to turn bodily around this pivot point. The inventors believe this may cause vibration and/or initiate whirling motion even though other cutter blocks of the reamer may oppose or limit such pivoting.

The reamer as described above, referring to FIGS. 1 to 7, is of a conventional construction. FIGS. 8 to 20 show parts of expandable reamers which utilise much of this conventional construction but have cutter arrangements and cutter blocks in accordance with novel concepts disclosed here. Specifically, the reamers of FIG. 8 onwards utilise the expandable block construction shown in FIGS. 2 and 3 and have cutter blocks with inner and outer parts as in FIG. 4.

Figure 8:
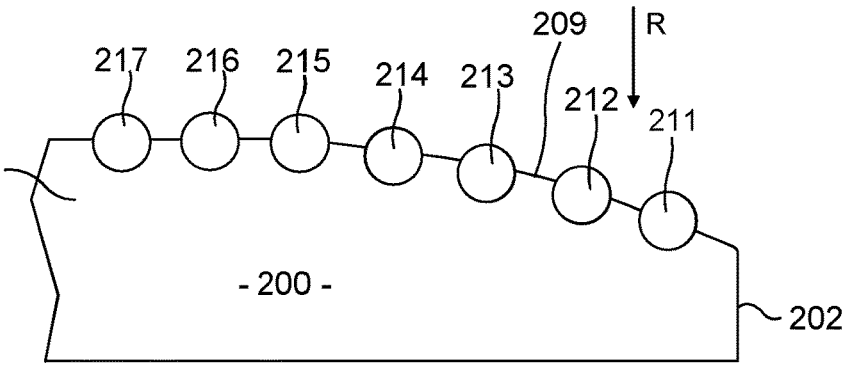
FIG. 8 is a side view of the lower cutting portion of a cutter block, with the tool axis horizontal.
Figure 9:
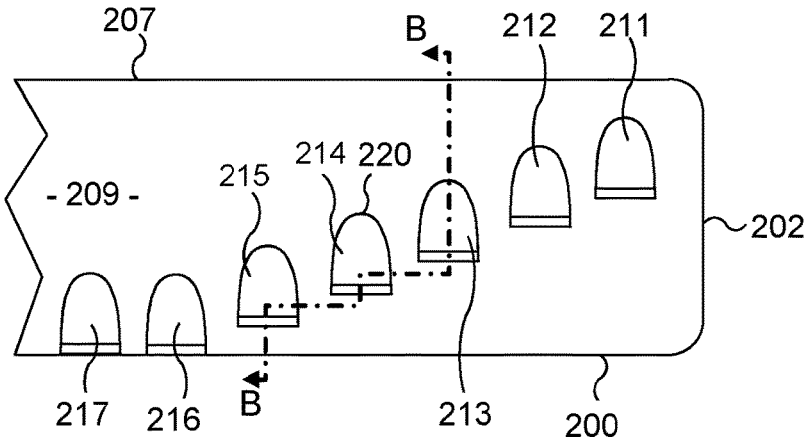
FIG. 9 is a view onto the lower cutting portion in the direction of arrow R of FIG. 8.

FIGS. 8 and 9 are schematic views of the lower portion of a cutting block with the tool axis shown as horizontal. The block has a side face 200 which is the leading face in the direction of rotation and it has a lower axial end face 202. The trailing face of the block is indicated 207 in FIG. 9 and the radially outward surface of the support structure is 209.

The side view, which is FIG. 8, shows that a sequence of PDC cutters 211-217 is distributed axially along the block with each of the cutters partially embedded in the support structure. Cutters 211-215 are at progressively increasing radial distances from the tool axis. Cutters 216 and 217 are at the maximum distance from the tool axis so that their radial extremities are at the full gauge of the tool. These two cutters are the leading cutters as the tool rotates and, as shown by FIG. 9, the circumferential positions of the other cutters 211-215 on the cutter block are behind these cutters 216 and 217. The leading face of cutter 215 is set back circumferentially from cutters 216 and 217 so that the leading face of cutter 215 is behind the leading faces of cutters 216 and 217 but ahead of the trailing ends of these cutters 216 and 217. The leading face of cutter 214 is set back circumferentially from cutter 215 so that the leading face of cutter 214 is behind the leading face of cutter 215 but ahead of the trailing end of cutter 215. The leading face of cutter 213 is between the leading face and trailing end of cutter 214 and so on with cutter 211 furthest from the leading face 200 of the block. Thus the sequence of cutters 211-217 includes a plurality 211-215 which are positioned between the leading face and trailing end of another cutter in the sequence.

Figure 10:
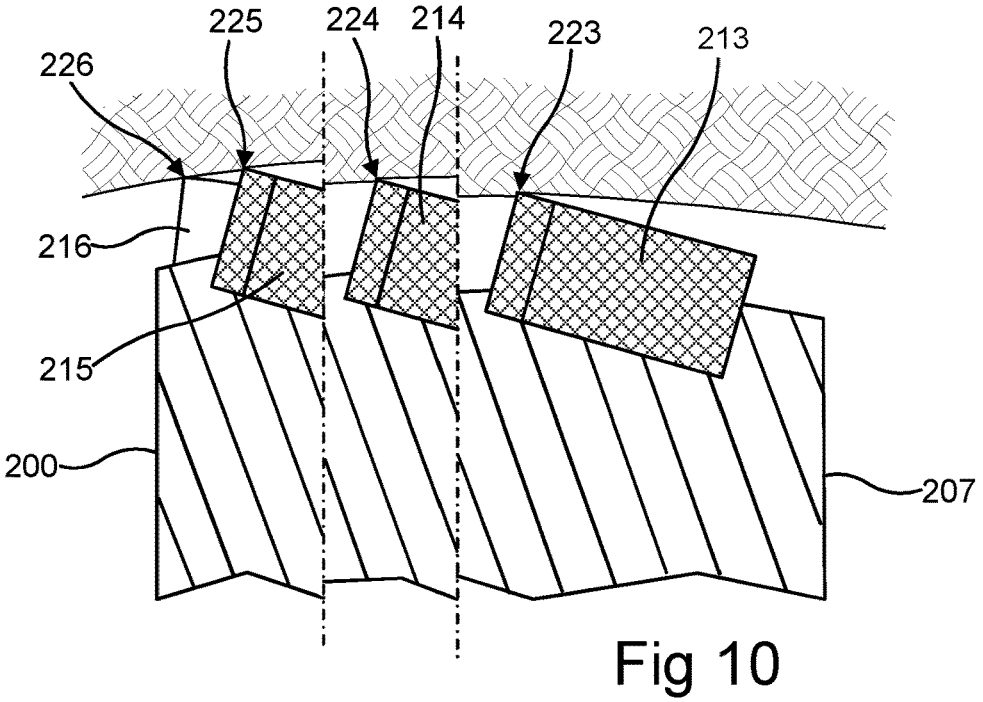
FIG. 10 is a diagrammatic cross section on the line B-B of FIG. 9.

FIG. 10 is a section taken on the chain-dotted line B-B of FIG. 9 so as to show the cutters 213, 214 and 215. Part of cutter 216 is also visible. If the radial extremity 223 of cutter 213 snags on the borehole wall, the cutter block may attempt to pivot around the extremity 223 in the sense seen as clockwise and denoted by arrow 182 in FIG. 10. However this is inhibited by the radial extremities of other cutters which are circumferentially forward of cutter 213 (specifically including extremities 224-226 of cutters 214-216) abutting the borehole wall. Similarly, if the extremity 224 of cutter 214 snags, pivoting around it is inhibited by cutters forwardly from it (including the extremities 225 and 226 of cutters of cutters 215 and 216). Pivoting around the extremity 225 of cutter 215 is inhibited by cutters 216 and 217 contacting the borehole wall. The cutters 216, 217 are at the leading edge of the cutter block and so there are no cutters forwardly of these: however, these cutters are at the same full gauge radius as cutter 215 and so when the reamer is advancing axially they will be moving across a borehole surface which has already been cut. Consequently they are less likely to snag and become a pivot point.

It will also be appreciated that this arrangement with cutters 211-215 at differing distances circumferentially back from the leading cutters 216, 217 reduces the number of cutters aligned along any line parallel to the tool axis and so reduces the likelihood of such a line becoming an unwanted pivot axis for the tool if a cutter snags on the borehole wall.

It can be seen in FIG. 9 that cutter 213 is ahead of the trailing end 220 of cutter 214 and slightly ahead of the trailing end of cutter 215. Similarly the leading face of cutter 214 is ahead of the trailing end of cutter 215. This positioning, in which the circumferential extents of the cutters overlap, is a space-saving feature. There might not be sufficient circumferential width across the cutter block for so many cutters if there was no such overlap.

An arrangement such as this, with cutters at varying distances from the leading face of the cutter block, can also be used in a portion of the cutter block where all the cutters are at full gauge. Furthermore, it is possible that circumferential distance from the leading face of the cutter block does not increase progressively but increases and decreases along the sequence of cutters in a manner resembling a random distribution of circumferential positions. Here also, the variation in circumferential distance behind the leading cutter(s) reduces the number of cutters aligned on any line parallel to the tool axis.

Figure 11:
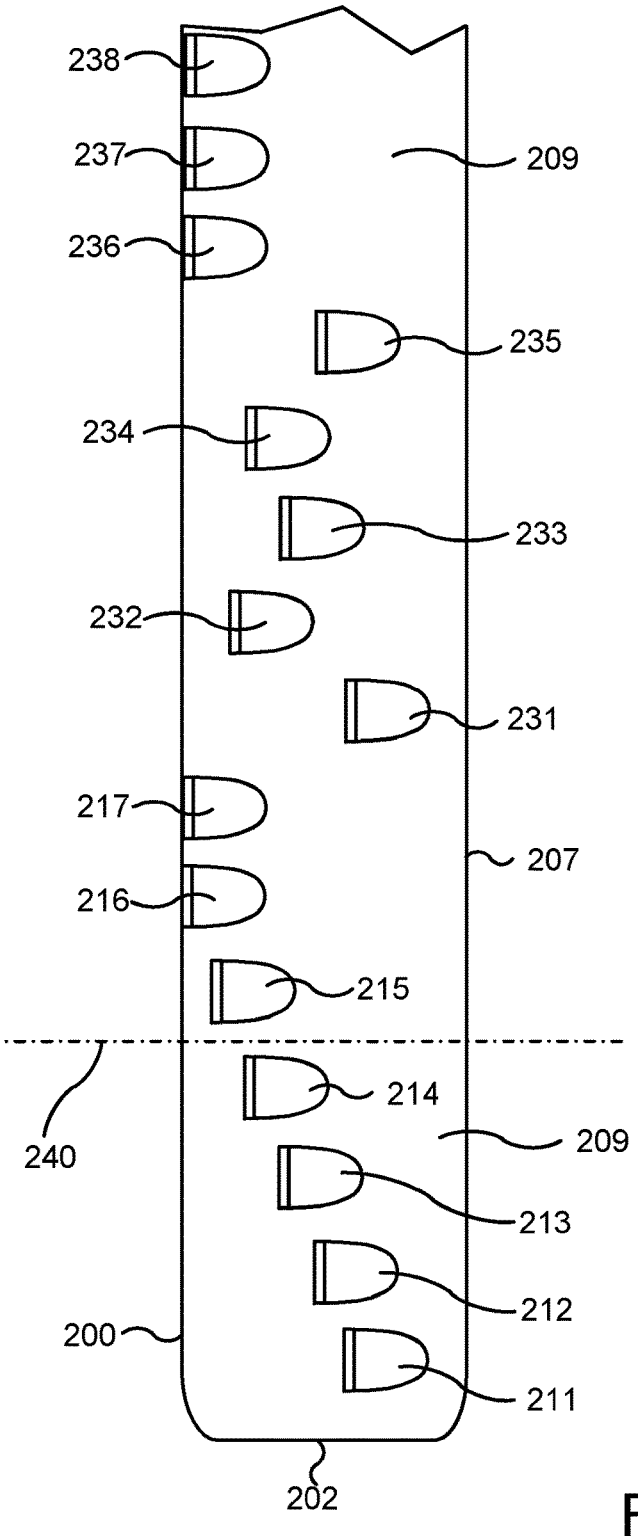
FIG. 11 is a view onto the middle and lower portions of a cutter block having a lower portion which is the same as in FIGS. 8 and 9, shown with the tool axis vertical.

These possibilities are illustrated by FIG. 11 which is a view onto middle and lower portions of a cutter block with the tool axis vertical. The cutters 211-217 are arranged as in FIGS. 8 and 9 with the extremities of cutters 211-214 (those below line 240) at radial distances from the tool axis which are less than full gauge. The cutters above line 240 are all at full gauge and thus at equal radial distance from the tool axis. These cutters are the cutter 215, cutters 216 and 217 at the leading face of the cutter block, cutters 231-235 behind the leading face of the block and cutters 236-238 which are also at the leading face the block.

The leading face of cutter 231 lies between the leading face and trailing end of cutter 235 and also cutter 233. The leading face of cutter 235 is between the leading faces and trailing ends of cutters 233 and 234. The leading face of cutter 233 is between the leading faces and trailing ends of cutters 232 and 234. The leading face of cutter 234 is between the leading face and trailing end of cutter 232 and the leading faces of both cutters 232 and 234 are between the leading faces and trailing ends of the cutters 216, 217, and 236-238 which are at the leading face of the cutter block. Thus the sequence of cutters 231 to 238 meets the requirement that at least some cutters (in this case cutters 231-235) of the sequence have their leading faces between the leading faces and trailing ends of other cutters. If any of the cutters 231 to 235 snags on the borehole wall, there are a number of cutters circumferentially ahead of the snagged cutter which will be able to prevent or limit pivoting around the radial extremity of the snagged cutter.

FIGS. 8 to 11 have been simplified in that they show the positioning of cutters relative to each other but do not show provision for inserting cutters into the support structure when these cutters have leading faces set back form the leading face of the cutter block. This is shown by the subsequent FIGS. 12-15 which show the lower cutting portion of the outer part of a cutter block. In these figures the tool axis is shown as horizontal. As with the conventional construction, the outer part of each cutter block is a steel support structure for PDC cutters.

Figure 12:
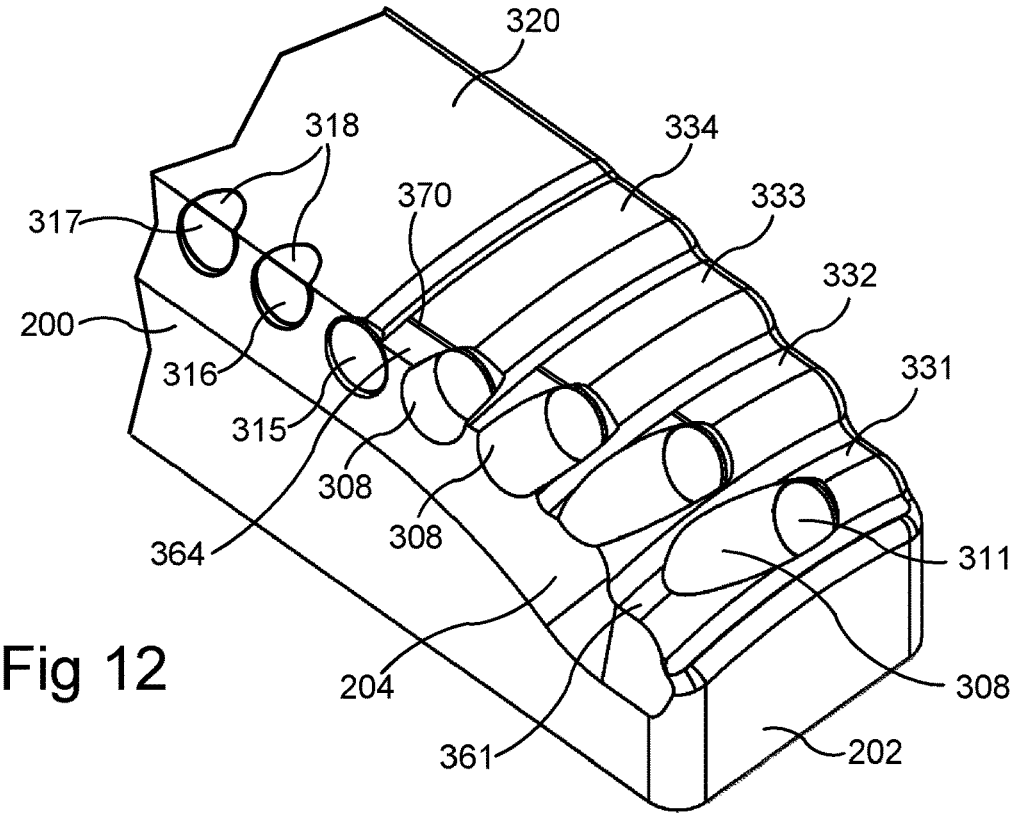
FIG. 12 is an isometric drawing of the lower cutting portion of the outer part of another cutter block, shown with the axial direction of the tool horizontal.
Figure 13:
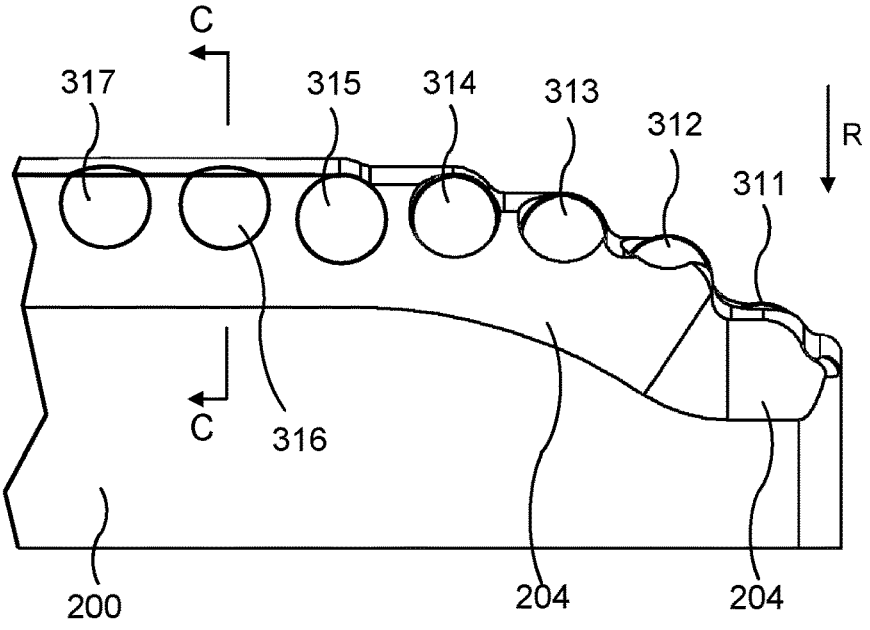
FIG. 13 is a side view of the lower cutting portion shown in FIG. 12, also shown with the axial direction of the tool horizontal.
Figure 14:
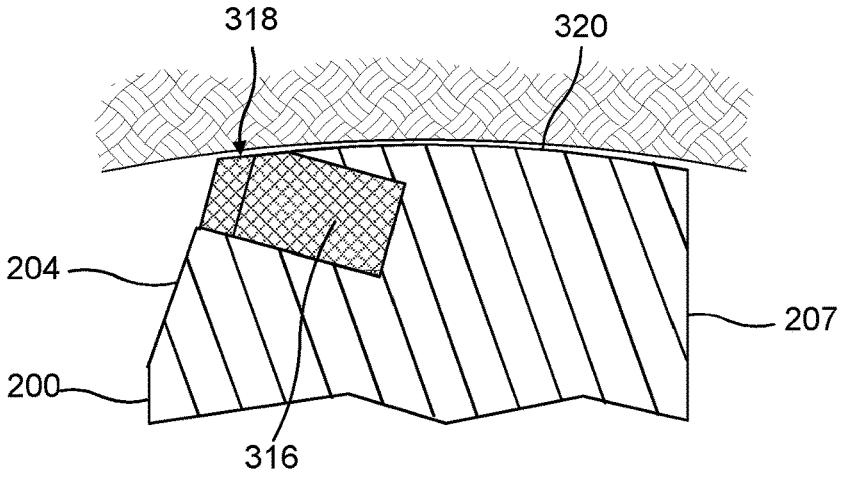
FIG. 14 is a section on line C-C of FIG. 13.

FIGS. 12 and 13 show the lower cutting portion of a block with a side face 200 which is the leading face in the direction of rotation. The leading face 200 of the block has an area 204 which is slanted back slightly. The block has an end face 202 at its lower axial end.

A sequence of PDC cutters 311-317 is positioned with the hard surfaces of the cutters exposed. The cutters 311-315 are at different positions, circumferentially on the cutter block, progressively advancing towards the leading face 200 of the block. The trailing end of cutter 311 is concealed within the support structure, but is close to the trailing face of the cutter block. The hard leading face of cutter 311 is between the leading face of cutter 312 and the trailing end (concealed by the support structure) of cutter 312. Similarly the hard faces of cutters 312, 313 and 314 are between the leading faces and trailing ends of cutters 313, 314 and 315 respectively. The extent to which the cutters extend back from their exposed leading faces is shown by double headed arrows 370 in FIG. 16.

The hard leading faces of cutters 311-315 are positioned at progressively increasing radial distances from the tool axis. Cutter 315 is at the maximum radius (i.e. is at full gauge) and the radial extremities of cutters 315-317 are all at the same radial distance from the tool axis. These cutters 311-317 are arranged in a single sequence and are the only cutters on the lower portion of the cutter block. Thus, in contrast with FIG. 4, there is no second row of cutters behind.

Each cutter is secured by brazing within a cavity in the support structure so that it is embedded in the supporting structure. The cutters 311-314 are set back from the leading face 200 of the block. To enable insertion of these cutters before they are secured by brazing, the tubular cavities in the support structure are prolonged forwardly and outwardly. Prolongations of the cavities are visible as curved recesses 308 in the outer face of the cutter block, extending forwardly from the cutters 311-314. The cutters 316 and 317 are made with a truncated cylindrical shape and are secured to the support structure such that, as seen in FIG. 12 and the cross section FIG. 14, their extremities are the area 318 where the cylindrical shape of the cutter has been truncated.

The outer surface 320 of the cutter block behind the cutters 315-317 is at the full gauge of the reamer and so when the cutter blocks are fully expanded, the outer surface 320 is part of a cylinder which is centred on the tool axis and lies on the notional surface swept out by the rotating tool. The outer extremities of the cutters 315-317 which are at the full gauge of the reamer also lie on this notional surface. This notional surface is akin to a surface of revolution, because it is the surface swept out by a rotating body, but of course the reamer may be advancing axially as it rotates.

The outer surface 320 extends over the cutters 316 and 317 and over half of cutter 315. Thus, as shown by the cross-section in FIG. 11, the cutter 316 (and also cutter 315) has its extremity 318 aligned with outwardly facing surface area which is behind the leading faces of these cutters 315-317 and follows these leading faces as the reamer rotates. The surface 320 lies close to or slides on the borehole wall and acts to stabilise the position of the rotating tool within the borehole.

The outer face of the block includes part-cylindrical surfaces 331-334 which extend behind the leading faces of cutters 311-314 respectively and which are aligned radially with the extremities of the respective cutters. Each of the part-cylindrical surfaces 331-334 has a radius which lies on the tool axis when the cutter blocks are fully expanded. These surfaces 331-334 act as secondary gauge areas: the surface 331 slides over rock which has just been cut by the action of cutter 311, surface 332 slides over rock cut by cutter 312 and so on. Of course, the rock surfaces created by cutters 311-314 have only a transient existence. They are cut away by cutters at a greater radius as the reamer advances. Nevertheless, this provision of secondary gauge areas contributes to stabilisation of the position of the rotating reamer.

The surfaces 331-334 each extend circumferentially from the trailing surface 207 of the cutter block to a step 372 which is aligned with the exposed face of a cutter. Between this step 372 and the leading face 200 of the cutter block there is a continuation of the surfaces at a slightly smaller radial distance from the tool axis. Two of these surfaces are indicated 361 and 364 in FIGS. 16 and 17.

Figure 15:
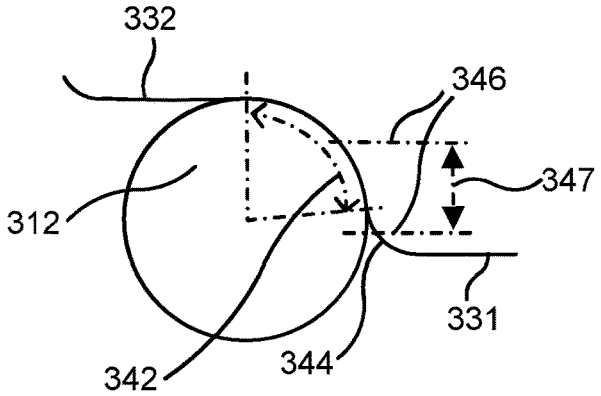
FIG. 15 is a diagrammatic enlarged view showing one cutter of FIG. 9.

The outer face of the block includes portions connecting the part cylindrical surfaces 331-334. Referring to FIG. 15, from the surface 332 towards surface 331 the outer face of the block curves through an arc (indicated by angle 342) where it is aligned with the perimeter of cutter 332. It then curves in the opposite sense, as seen at 344, to join the part cylindrical surface 331. There is a similar arrangement between surfaces 334 and 333, between 333 and 332 and also between surface 331 and a part cylindrical surface 340 located between cutter 311 and the axial end of the block. However, surfaces 320 and 334 connect through a tapering surface 372.

FIG. 15 shows that the portions of the outer face of the block between surfaces 331-334 have zones, such as indicated at 347 between the chain lines 346, which face in a generally axial direction and so face towards formation rock which is to be cut away as the reamer advances axially. Facing in a generally axial direction may be taken to mean that a line normal (i.e. perpendicular) to the surface is at an angle of no more than 45° to the tool axis. In order that contact between these zones and the rock does not prevent axial advance of the reamer, these zones are slanted so that their circumferential extent does not run exactly orthogonal to the reamer axis.

Figure 16:
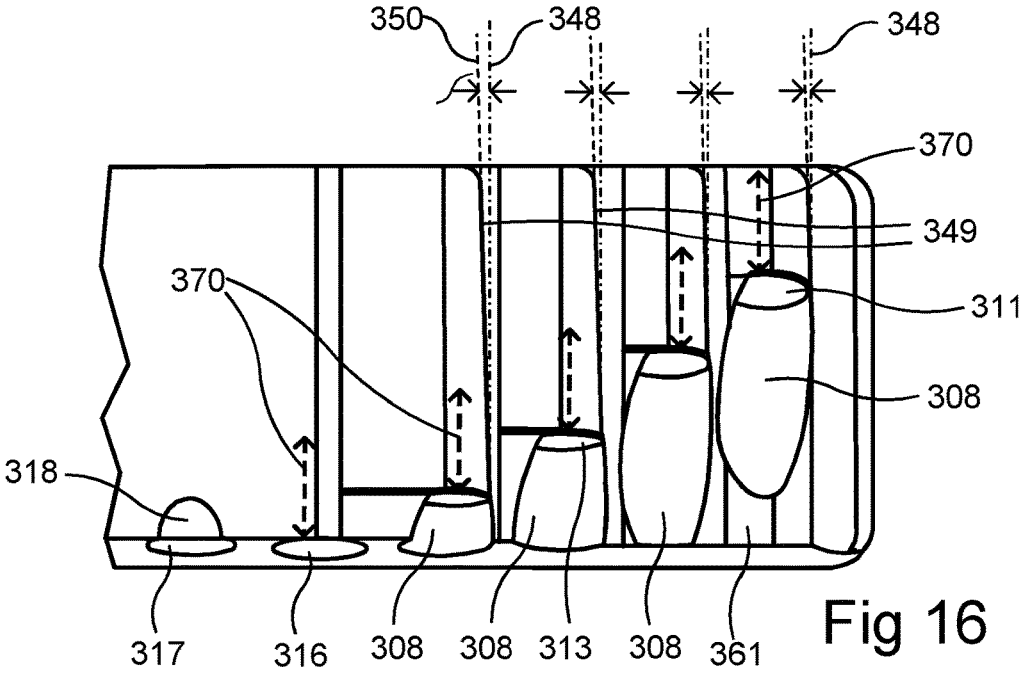
FIG. 16 is a radial view onto the end portion of a cutter block in the direction of arrow R of FIG. 13.

This is shown in FIG. 16 which shows a radial view in the direction of arrow R onto the lower cutting portion of the cutter block of FIGS. 8 and 9. Directions orthogonal to the axis of the reamer are shown by chain dotted lines 348. The lines 349 aligned with edges of cutters 311-313 are the inflection where curvature through arc 342 changes to curvature through arc 344. The portions of outer surface which face generally axially are shaped to taper away from the end of the cutter block (and also the end of the reamer) as they extend circumferentially around the tool axis, back from the leading faces of the cutters. Thus the lines 349 are at an angle to the orthogonal direction indicated by the lines 348. This is emphasised in FIG. 16 by the dashed lines 350 which are a continuation of lines 349.

Figure 17:
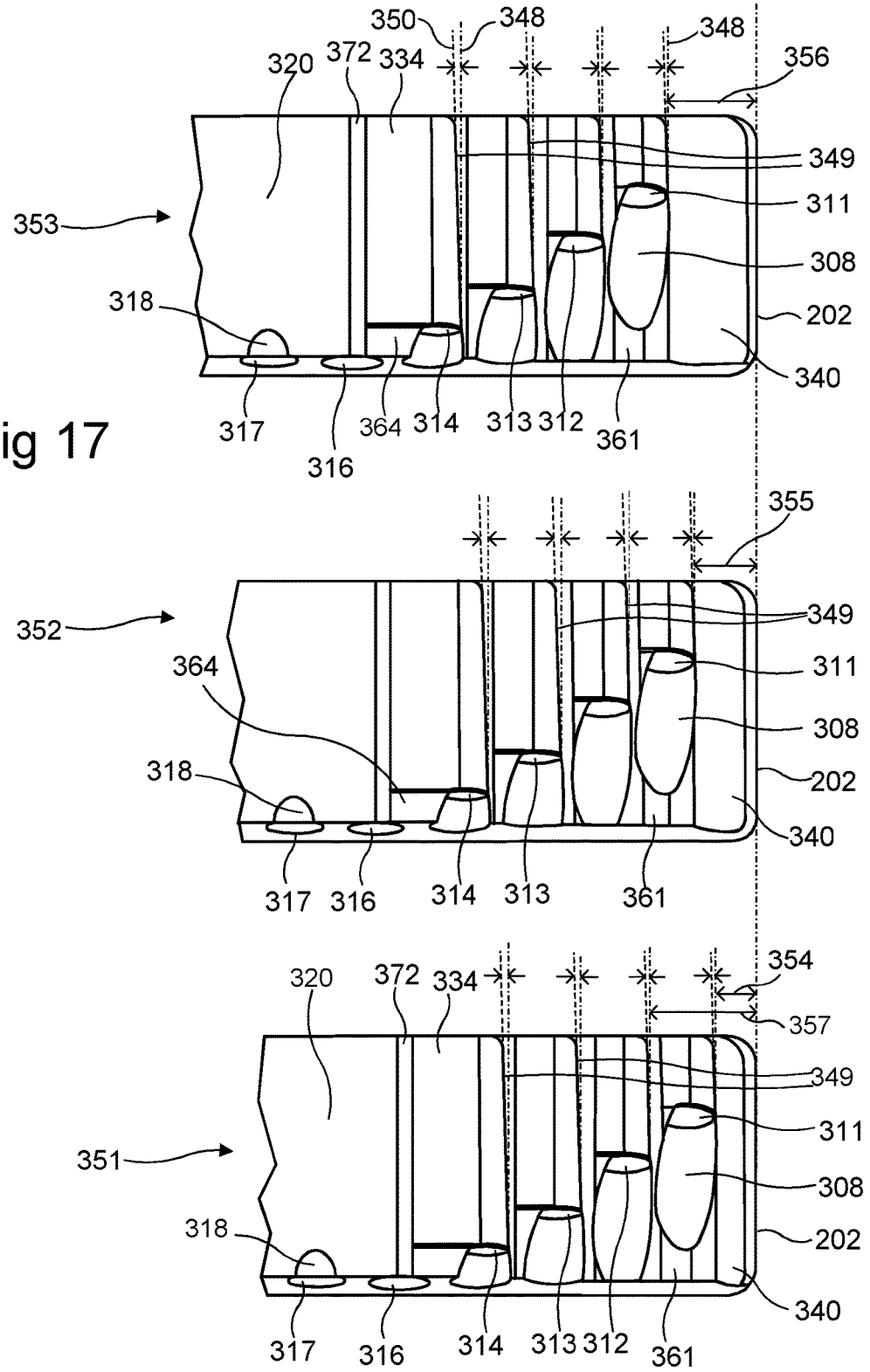
FIG. 17 is a radial view onto the lower cutting portions of three cutter blocks.

As shown in FIG. 17, the ends 202 of the blocks are aligned axially as indicated by a chain-dotted line. The block shown in FIGS. 12-16 is block 351 at the bottom of the diagram. The lower cutting portions of the other two blocks are indicated at 352 and 353. These follow block 351 as the reamer is rotated and of course block 351 follows block 353. The configuration of cutters 311-314 and the supporting structure around them, as described above with reference to FIGS. 12 to 15 for block 351, is reproduced on blocks 352 and 353. Thus the axial and radial positions of cutters 311-314 and the surrounding support structure including surfaces 331-334 relative to each other is the same on all three cutter blocks, but the axial distances between these functional parts and the ends of the blocks and the radial distances from these functional parts to the tool axis differs from one block to another. Since the blocks are aligned and move in unison, the axial distances between functional parts and the end of the tool, or any other reference point on the tool body, differ from one block to another in the same way as the distances between these functional parts and the ends of the blocks.

As indicated by the arrows 354, 355, 356 the axial distances from the end of each block to the edge of cutter 311, and likewise the distances to the other cutters, increase in the order: block 351, block 352, block 353. However, the distance indicated by arrow 356 to the edge of cutter 311 of block 353 is not as great as the distance 357 to the edge of cutter 312 of block 351. The cutters 311-314 of the block 352 are also positioned radially slightly further from the axis of the tool than the corresponding cutters of block 351. Similarly the cutters 311-314 of block 353 are positioned slightly further from the axis of the tool than the corresponding cutters 311-314 of block 352. Axial distances from the ends of the blocks to the cutters 315 also increase in the order block 351, block 352, block 353, but the cutters 315 are at full gauge and so are at the same radial distance from the tool axis.

This arrangement of axial and radial positions means that as the cutters' distance from the ends of the blocks (and also from an end of the tool) increases, their radial distance from the tool also increases. This allows all the cutters to take part in cutting, rather than throwing most of the task of cutting rock onto only a few of the cutters on the tool.

Figure 18:
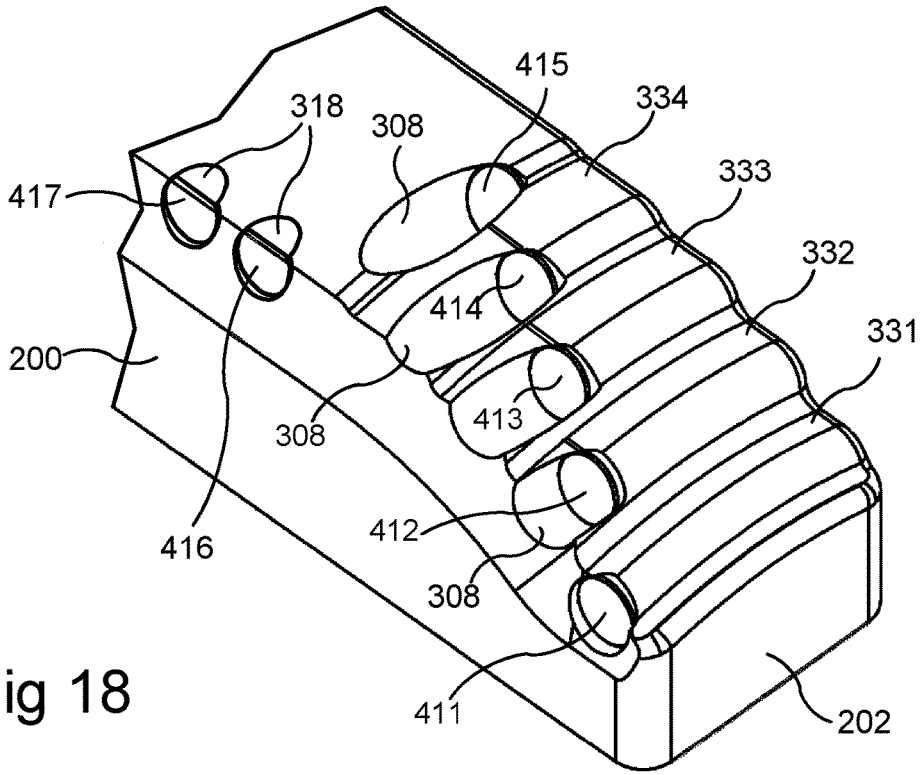
FIG. 18 is an isometric drawing of the lower cutting portion of the outer part of a further cutter block.
Figure 19:
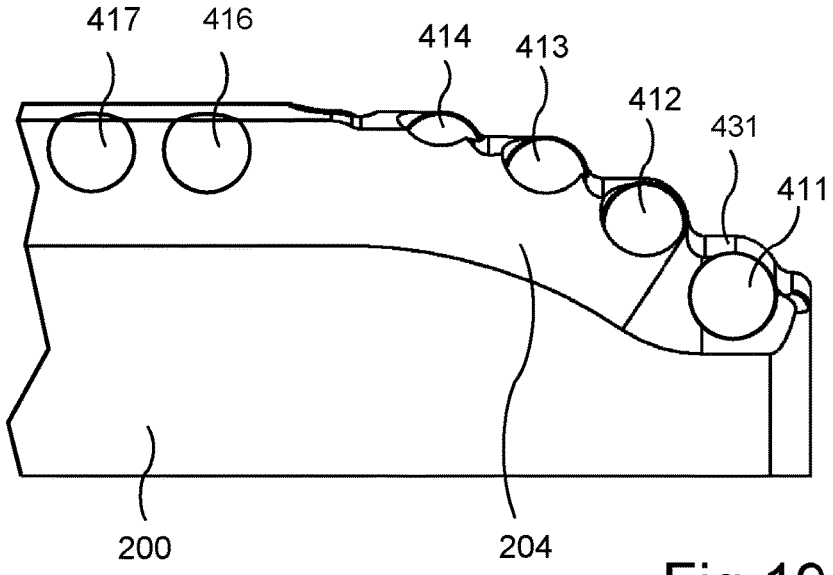
FIG. 19 is a side view of the lower cutting portion shown in FIG. 18.

FIGS. 18 and 19 also show an arrangement of cutters on the lower portion of cutter blocks. The arrangement has many features in common with that described with reference to FIGS. 12-15, and the cutters 411-417 are at similar axial and radial positions to the cutters 311-317 already described. However, the circumferential positions of the cutters are such that the progressive circumferential positioning of the hard faces of the cutters is reversed. Cutter 415 has its trailing end concealed within the support structure close to the trailing face of the cutter block. The hard leading face of cutter 415 is between the leading face of cutter 414 and the trailing end of cutter 414. Similarly the hard faces of cutters 414, 413 and 412 are between the leading faces and trailing ends of cutters 413, 412 and 411 respectively. The hard face of cutter 412 is also between the hard faces of cutters 416 and 417. The hard face of cutter 411 is at the leading edge of the cutter block, approximately aligned with the hard faces of cutters 416 and 417.

Part-cylindrical surfaces 331-334 are at the same radial distances from the tool axis as the radial extremities of cutters 411-414 and extend circumferentially behind these cutters in similar manner to the arrangement shown in FIG. 12.

Figure 20:
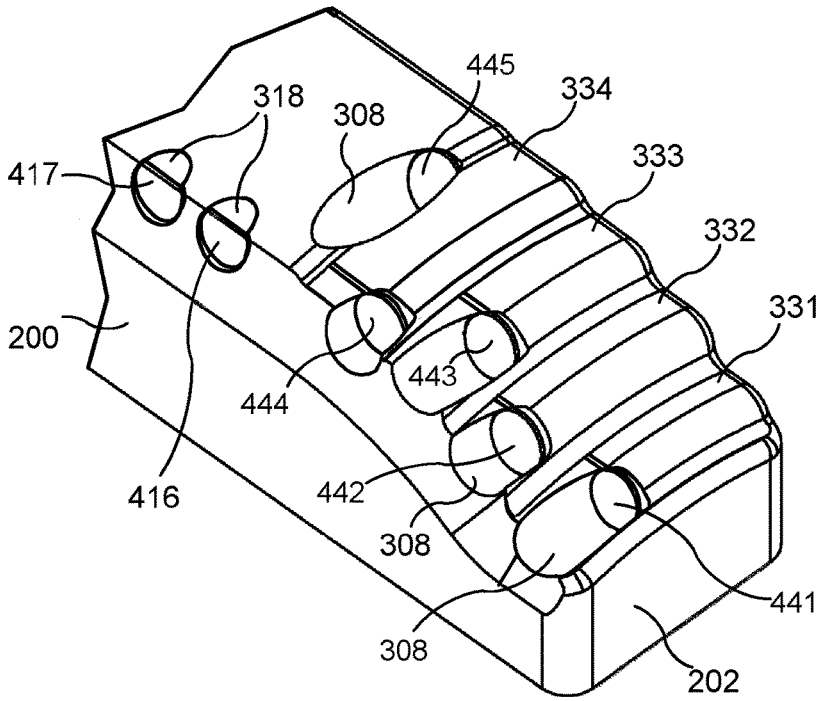
FIG. 20 is an isometric drawing of the lower cutting portion of the outer part of another cutter block.
Figure 21:
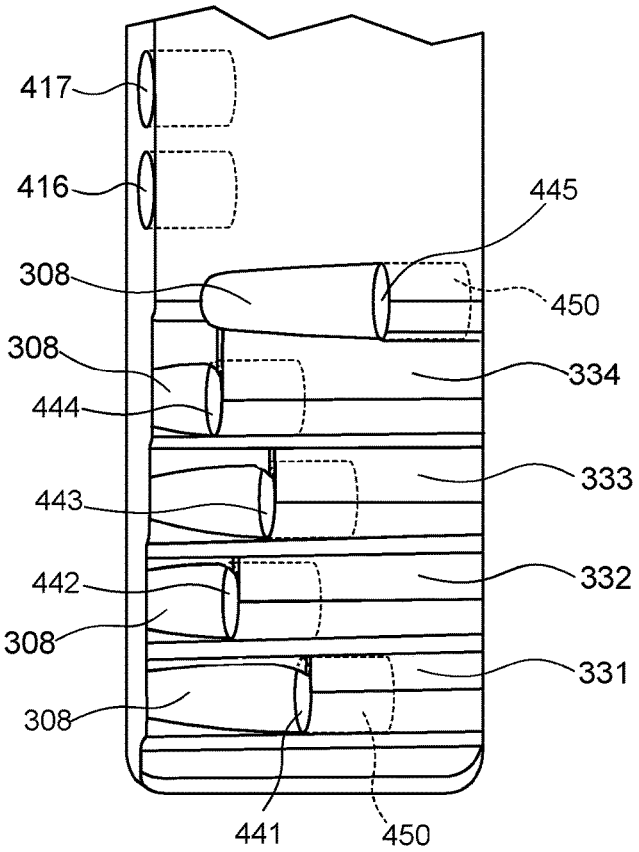
FIG. 21 is a view onto the outward facing surfaces of the cutter block of FIG. 20.

FIG. 20 is analogous to FIGS. 12 and 18 and shows a further possible arrangement of cutters. FIG. 21 is a view onto the block of FIG. 20 and shows the bodies of cutters, embedded in the outer part of the cutter block, as a dashed outline 450. The cutters 441-445 are at similar radial and axial positions to cutters 311-315 and 411-415 in FIGS. 12 and 18, but their circumferential positions relative to the leading cutters 416, 417 do not increase or decrease progressively along the sequence. Between the leading cutter 416 and the cutter 441 at the axial end of the cutter block, the circumferential distances behind the leading face of cutter 416 both increase and decrease.

The leading face of cutter 444 is circumferentially between the leading faces and trailing ends of cutters 416 and 417. The leading face of cutter 442 is slightly behind the leading face of cutter 444 and ahead of its trailing end. The leading faces of cutters 441 and 443 are between the leading and trailing faces of cutter 442. The last cutter 445 behind all the others has its leading face between the leading face and trailing end of cutter 441.

Figure 22:
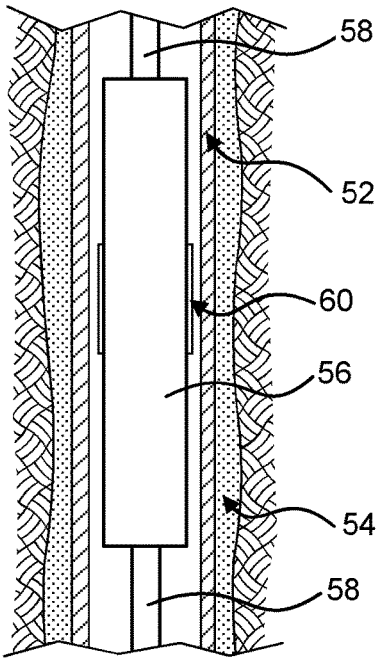
FIGS. 22, 23 and 24 schematically illustrate a task performed by an expandable milling tool.
Figure 23:
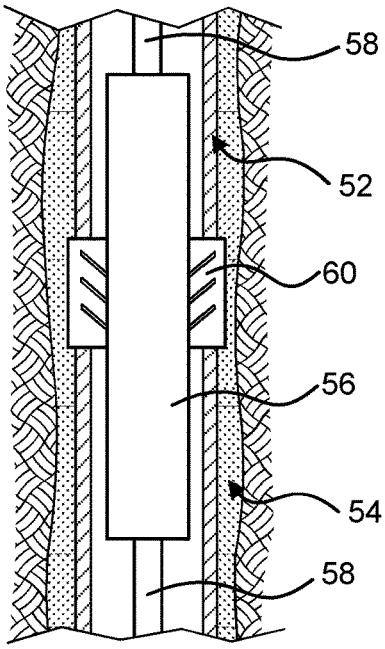
Figure 24:
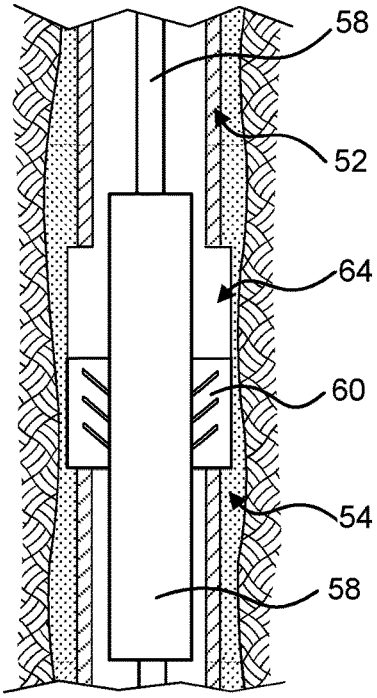

The invention disclosed here can also be embodied in a milling tool for removing tubing within a borehole by cutting into and through the tubing from is inside face. The general function of such a tool is illustrated by FIGS. 22 to 24. As shown by FIG. 22 an existing borehole is lined with tubing 52 (the wellbore casing) and cement 54 has been placed between the casing and the surrounding rock formation. The tubing and cement may have been in place for some years. It is now required to remove a length of tubing, starting at a point below ground. One possible circumstance in which this may be required is when a borehole is to be abandoned, and regulatory requirements necessitate removal of a length of tubing and surrounding cement in order to put a sealing plug in place.

As shown by FIG. 22 a milling tool 56 with a generally cylindrical body is included in a drillstring 58 which is lowered into the borehole. This drill string can be formed from conventional drill pipe which is able to convey drilling fluid down to the milling tool 56 and which is rotatable by a drive motor at the surface. In an alternative arrangement (not shown) the milling tool could be attached to a hydraulic motor attached to coiled tubing inserted into the borehole. This expandable tool uses the construction and drive machinery shown by FIGS. 2 and 3, with three extendable cutter blocks 60 at 120° intervals azimuthally around the tool body. In FIG. 22 these blocks are retracted into the tool body.

When the milling tool 56 has been inserted to the desired depth in the borehole, the cutter blocks 60, represented diagrammatically as rectangles in FIGS. 22 to 24 are expanded from the tool body as the tool is rotated. The cutters on the blocks 60 cut outwards, into and through the tubing, as shown diagrammatically by FIG. 23. The fully expanded cutter blocks 60 extend beyond the tubing into the surrounding cement 54.

Once the cutters have been fully expanded as shown by FIG. 23, the rotating drillstring 58 is advanced axially down the borehole, removing tubing 52 and some of the surrounding cement 54. This is shown by FIG. 24. As the tool is advanced axially downhole, the cavity 64 above it has the diameter swept out by the extended cutter blocks 60 and is larger than the outside diameter of the tubing 52 which is being removed.

Figure 25:
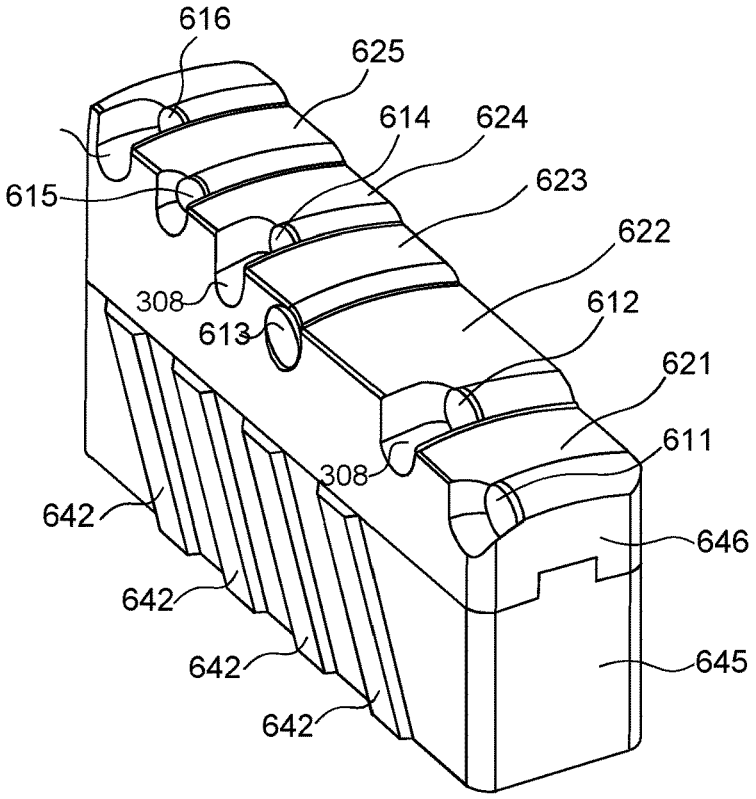
FIG. 25 is an isometric view of the cutter block of the expandable milling tool.
Figure 27:
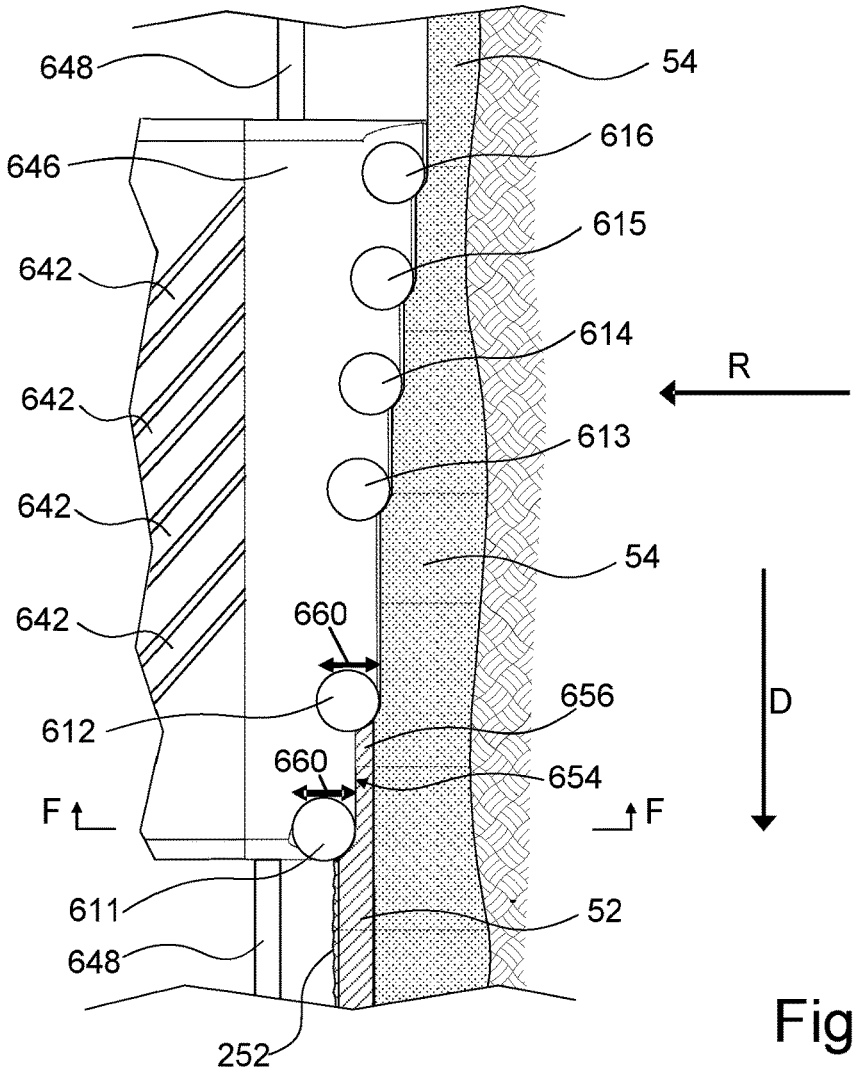
FIG. 27 shows an elevational view of a cutter block of the expandable milling tool of FIGS. 25 and 26, in use to remove tubing.

One cutter block 60 is shown in isometric view in FIG. 25. Its operation to mill tubing is shown by FIG. 27. The cutter block has an inner part 645 with protruding ribs 642 which is similar in construction and operation to the inner part 145 shown in FIG. 4. The cutter block has an outer part 646 which may be a steel structure and carries cutters 611-616 which are cylinders of hard material. The cutting surfaces are end faces of the cylinders and face forwardly in the direction of rotation of the tool 56.

Each cutter may be secured within a socket (a tubular cavity) in the block's outer part 646 by brazing, although other methods of securing cutters may alternatively be employed. The body of each cutter, embedded in the outer part of the cutter block is shown as a dashed outline in FIG. 26. Each cutter is made of hard material which may be tungsten carbide powder sintered with some metallic binder. Other hard materials may be used in place of tungsten carbide. Possibilities include carbides of other transition metals, such as vanadium, chromium, titanium, tantalum and niobium. Silicon, boron and aluminium carbides are also hard carbides. Some other hard materials are boron nitride and aluminium boride. A hard material may have a hardness of 1800 or more on the Knoop scale or a hardness of 9 or more on the original Mohs scale (where diamond has a Mohs hardness of 10).

The radially outward facing surface of the outer block part 646 comprises a number of part cylindrical surfaces 621-626 with radii such that these surfaces 621-626 are centered on the tool axis when the cutter blocks are fully extended. The cutter 611 is positioned so that its radially outer extremity is at the same distance from the tool axis as the surface 621. This pattern of a cutter extremity and a part-cylindrical outward facing surface both at the same distance from the tool axis is repeated along the block by cutter 612 whose extremity is at the radius of surface 622, likewise cutter 613 with surface 623, cutter 614 with surface 624 and cutter 615 with surface 625 at progressively greater radial distances from the tool axis. Transitional surfaces connecting adjacent surfaces 621 and 622, similarly 622 and 623 and so on, have the same curvature as, and are aligned with, the curved edges of the cutters.

Figure 26:
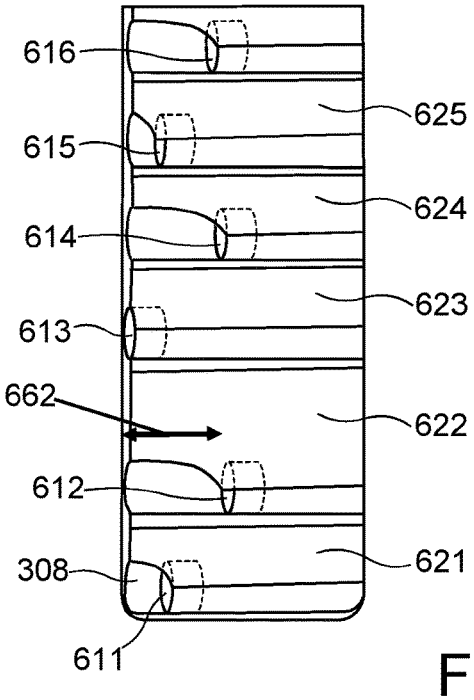
FIG. 26 is a view onto the cutter block of FIG. 25 in the radial direction indicated by arrow R in FIG. 27.

As shown by FIGS. 25 and 26, these cutters have circumferential positions on the block's outer part 646 such that the cutters are not all aligned on any single line parallel to the tool axis. On the contrary, and in accordance with the concepts disclosed here, cutter 613 is at the leading face of the cutter block and the other cutters 611, 612 and 614-616 are at varying distances circumferentially behind cutter 613. The circumferential distances between the leading face of cutter 613 and the leading faces of other cutters both increases and decreases along the sequence of cutters 611-616. In order to allow insertion of cutters into the block's outer part 646, recesses 308 extend forwardly from the cutters 611, 612 and 614-616.

FIG. 27 shows part of a cutter block when the tool 56 is in use to remove tubing 52 within a borehole. There is cement 54 outside the tubing 52 between it and the surrounding rock formation. The tool has already been placed in the borehole and expanded while rotating the tool so as to cut into and through the tubing 52. An edge of the outer wall of the tool body exposed at the side of a recess 116 (see FIG. 2) is indicated 648 in FIG. 7. The tool is now advancing axially in the downward direction shown by arrow D. The tubing 52 may have some corrosion and deposited material on its inside surface as depicted schematically at 252. In the fully expanded position of the cutter blocks, the axially lowest cutters 611 on each cutter block are positioned to remove this material 252 and also remove some material from the inside wall of the tubing 52, thus exposing a new inward facing surface 654.

It should be appreciated that the expansion of the cutter blocks by the mechanism within the tool body proceeds as far as the drive mechanism in the tool body will allow. If necessary, the amount of expansion is limited when preparing the tool at the surface by adjusting the screwthreaded spring retainer 540, using a wrench in the wrench slot 588 while the tool as at the surface so that expansion goes no further than required. The adjustment of expansion is arranged such that when the cutter blocks are fully expanded, the surfaces 621 and the outer extremities of the leading cutters 611 are at a radial distance from the tool axis which is slightly greater than the inner radius of the tubing 52 but less than the outer radius of the tubing. As already mentioned, the curvatures of the part-cylindrical outward facing surfaces 621 to 625 are such that each of them is centred on the tool axis when the cutter blocks have been expanded.

Figure 28:
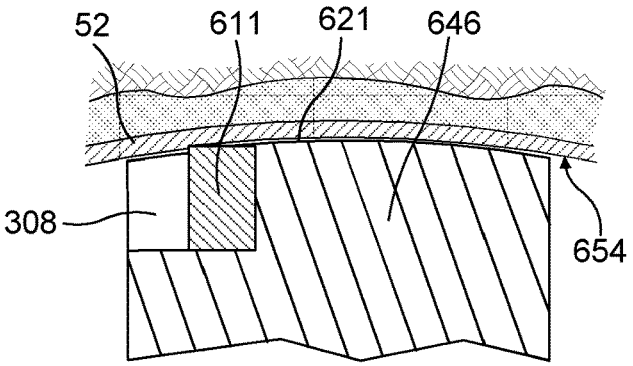
FIG. 28 is a cross section on the line F-F of FIG. 27.

The new internal surface 654 on the tubing 52 is at a uniform radius which is the radial distance from the tool axis to the extremities of the leading cutters 611. Because the surfaces 621 of the three blocks have a curvature which is centered on the tool axis and at the same radial distance from the tool axis as the extremities of the leading cutters 611, they are a close fit to this new surface 254 created by the cutters 611, as is shown in FIG. 28, and act as guide surfaces which slide over this new internal surface 654 as the tool rotates. The tool axis is thus positioned accurately, relative to the tubing 52.

As the tool advances axially, the cutters 612 which extend outwardly beyond the surfaces 621 remove the remainder of the tubing (indicated at 656) outside the new surface 654 so that the full thickness of the tubing 52 has then been removed. The cutters 613 to 616 cut through cement 54 which was around the outside of the tubing 52.

It is expected that cutting made by the cutters 611 and 612 will have a thickness which is less than half the extent of these cutters in the direction which is radial to the tool axis, which is the diameter of the cutting surfaces of these cutters, indicated by arrows 660 in FIG. 27. The circumferential positions of the cutters 611-616 on the cutter block outer part 646 are such that the circumferential distance between the cutting faces of the leading cutter 613 and the last cutter 614, indicated by arrow 662 in FIG. 26 is more than the dimension 660, but not more than twice this dimension.

Modifications to the embodiments illustrated and described above are possible, and features shown in the drawings may be used separately or in any combination. The arrangements of stabilising pads and cutters and/or the feature of gauge surfaces projecting forwardly of cutter extremities, could also be used in a reamer which does not expand and instead has cutter blocks at a fixed distance from the reamer axis. Other mechanisms for expanding a reamer are known and may be used. Cutters may be embedded or partially embedded in supporting structure. They may be secured by brazing or in other ways. The hard faces of the cutters will of course need to be exposed so that they can cut rock, but the radially inner part of a cylindrical cutters' hard face may possibly be covered or hidden by a part of the support structure so that the hard face is only partially exposed.

The invention claimed is:

1. A rotary cutting tool for enlarging an underground hole, comprising:

a plurality of cutter assemblies distributed azimuthally around a longitudinal axis of the tool, wherein each cutter assembly includes a supporting structure and a plurality of cutters, the supporting structure including a leading surface, a gauge region, and a lower region, the lower region bearing a sequence of cutters which are axially below the gauge region and extends axially along the tool with each cutter of the sequence of cutters having a leading face facing in a direction of rotation of the tool, and wherein the cutters of the sequence of cutters are positioned at a plurality of circumferential positions such that:

the leading faces of no more than three cutters of the sequence of cutters are aligned on any line parallel to the longitudinal axis of the tool; and the leading faces of the sequence of cutters increase in distance from the leading surface of the supporting structure as the sequence of cutters progresses axially farther from the gauge region, and wherein the supporting structure comprises an outward-facing surface behind the leading face of at least one cutter of the sequence of cutters and aligned with a radially outward extremity of the at least one cutter of the sequence of cutters so that the at least one cutter of the sequence of cutters does not project outwardly beyond the said outward-facing surface behind the at least one cutter of the sequence of cutters.

2. The rotary cutting tool of claim 1 wherein the cutters of the sequence of cutters are positioned at a plurality of circumferential positions such that the leading faces of no more than two cutters of the sequence of cutters are aligned on any line parallel to the longitudinal axis of the tool.

3. The rotary cutting tool of claim 1 wherein the sequence of cutters has each cutter at a different radial distance from the longitudinal axis of the tool.

4. The rotary cutting tool of claim 1 wherein the rotary cutting tool is a reamer in which the cutters comprise bodies with hard surfaces exposed as the leading faces of the plurality of cutters and the circumferential positions of the plurality of cutters are such that the leading face of each one of a plurality of cutters in the sequence of cutters is circumferentially behind the leading face but ahead of the trailing end of at least one other cutter in the sequence of cutters.

5. The rotary cutting tool of claim 1 wherein the sequence of cutters comprises at least one cutter at the leading face of the support structure and a plurality of cutters behind the leading face of the support structure, and wherein the leading face of each of the plurality of cutters behind the leading face of the support structure is circumferentially behind the leading face but ahead of the trailing end of at least one other cutter.

6. The rotary cutting tool of claim 1 wherein the radially outward extremity of the at least one cutter of the sequence of cutters is a surface area extending parallel to the tool axis.

7. The rotary cutting tool of claim 1 wherein the sequence of cutters comprises a plurality of cutters which are positioned at a leading surface of the support structure of the cutter assembly and at a maximum distance from the tool axis and which have radially outward extremities which are surface areas extending parallel to the tool axis.

8. The rotary cutting tool of claim 1 wherein the cutter assemblies are expandable radially from the tool axis.

9. The rotary cutting tool of claim 1 wherein the rotary cutting tool is a reamer and the plurality of cutters have polycrystalline diamond hard cutting surfaces.

10. The rotary cutting tool of claim 1 wherein each cutter of the sequence of cutters has a different circumferential distance from the leading surface of the supporting structure.

11. A rotary cutting tool for enlarging an underground hole, comprising:

a plurality of cutter assemblies distributed azimuthally around a longitudinal axis of the tool, wherein each cutter assembly includes a supporting structure bearing a sequence of cutters which extends axially along the tool with leading faces facing in a direction of rotation of the tool, and wherein the cutters are positioned at a plurality of circumferential positions such that the leading face of each cutter of a plurality of cutters in the sequence of cutters is circumferentially behind the leading face but ahead of the trailing end of at least one other cutter and a distance between a leading surface of the support structure and at least some of the cutters of the plurality of cutters in the sequence of cutters increasing in an axially downhole direction, and wherein at least one cutter of the sequence of cutters has the leading face thereof at a position circumferentially ahead of remaining cutters in the sequence of cutters, thereby being a leading cutter of the sequence of cutters, and the leading faces of the remaining cutters of the sequence of cutters are at circumferential distances behind the leading face of the at least one leading cutter which increase and decrease along the sequence of cutters.

12. The rotary cutting tool of claim 11 wherein the sequence of cutters comprises at least four cutters and at least three of the cutters are positioned such that the leading face of each of the at least three of the cutters is circumferentially behind the leading face but ahead of the trailing end of at least one other cutter.

13. The rotary cutting tool of claim 11 wherein the leading faces of the remaining cutters are all at different circumferential distances behind the behind the leading face of the leading cutter.

14. The rotary cutting tool of claim 11 wherein the sequence of cutters comprises a plurality of leading cutters which are positioned at the leading face of the support structure and at a maximum distance from the tool axis, together with a plurality of cutters behind the leading face of the support structure, and wherein the cutters behind the leading face of the support structure comprise a plurality of cutters which are at differing distances from the tool axis and each of which has the leading face thereof circumferentially behind the leading face but ahead of the trailing end of at least one other cutter.

15. A method of enlarging a hole underground by rotating a rotary cutting tool as defined in claim 1 in the hole and advancing the tool axially.

* * * * *